US009207607B2

(12) United States Patent
Higashi et al.

(10) Patent No.: US 9,207,607 B2
(45) Date of Patent: Dec. 8, 2015

(54) IMAGE FORMING APPARATUS CAPABLE OF ACCURATELY ESTIMATING POWER CONSUMPTION LEVEL

(71) Applicant: KONICA MINOLTA, INC., Chiyoda-ku (JP)

(72) Inventors: Natsuyo Higashi, Toyokawa (JP); Shigetaka Kato, Shinshiro (JP); Hideki Nakamura, Hachioji (JP); Katsufumi Suzuki, Okazaki (JP); Hirotada Seki, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/927,170

(22) Filed: Jun. 26, 2013

(65) Prior Publication Data

US 2014/0003830 A1 Jan. 2, 2014

(30) Foreign Application Priority Data

Jul. 2, 2012 (JP) ..... 2012-148653

(51) Int. Cl.
*G03G 15/20* (2006.01)
*G03G 15/00* (2006.01)

(52) U.S. Cl.
CPC ..... *G03G 15/5004* (2013.01); *G03G 15/205* (2013.01); *G03G 15/2003* (2013.01);
(Continued)

(58) Field of Classification Search
CPC ..... G03G 15/20
USPC ..... 399/69
See application file for complete search history.

(56) References Cited

U.S. PATENT DOCUMENTS 5,483,149 A * 1/1996 Barrett ..... 323/300
7,324,773 B2 * 1/2008 Sugiyama ..... 399/88
(Continued)

FOREIGN PATENT DOCUMENTS

JP 08-160805 A 6/1996
JP 10-162935 A 6/1998
(Continued)

OTHER PUBLICATIONS

Japanese Notice of Reasons for Refusal dated Nov. 4, 2014 issued in the corresponding Japanese Patent Application No. 2012-148653 and English translation (7 pages).

*Primary Examiner* — Clayton E Laballe
*Assistant Examiner* — Kevin Butler
(74) *Attorney, Agent, or Firm* — Buchanan Ingersoll & Rooney PC

(57) ABSTRACT

An image forming apparatus that heat-fixes a toner image onto a recording sheet passing through a fixing nip formed by pressing a pressurizing member against a heating rotational body heated by a heater, comprising: a storage unit storing a basic power consumption level of the heater determined in advance in a situation where inflow of inrush current to the heater is not occurring; an estimation unit calculating an estimated power consumption level of the heater by estimating an increase in the power consumption level, with respect to the basic power consumption level, brought about by inflow of inrush current to the heater; and an output unit outputting the estimated power consumption level. The heater switches between a heating state of receiving power supply and a non-heating state of not receiving power supply. The increase is estimated according to a duration of a non-heating state immediately preceding the heating state.

18 Claims, 11 Drawing Sheets

(52) U.S. Cl.
CPC ..... *G03G15/2078* (2013.01); *G03G 15/2082* (2013.01); *G03G 2215/2016* (2013.01); *G03G 2215/2032* (2013.01)

(56) References Cited

U.S. PATENT DOCUMENTS

| | | | | |
|---|---|---|---|---|
| 7,433,620 | B2 * | 10/2008 | Sekiguchi et al. | 399/70 |
| 7,565,086 | B2 * | 7/2009 | Tsujimura | 399/37 |
| 7,721,121 | B2 * | 5/2010 | Kim et al. | 713/300 |
| 8,594,520 | B2 * | 11/2013 | Kohri et al. | 399/31 |
| 2007/0098431 | A1 * | 5/2007 | Sugiyama | 399/88 |
| 2007/0212092 | A1 * | 9/2007 | Tsujimura | 399/69 |
| 2007/0230980 | A1 * | 10/2007 | Na et al. | 399/69 |
| 2011/0064431 | A1 * | 3/2011 | Kohri et al. | 399/37 |
| 2012/0106995 | A1 * | 5/2012 | Hirano | 399/45 |
| 2013/0094876 | A1 * | 4/2013 | Okunishi et al. | 399/88 |
| 2014/0003830 | A1 * | 1/2014 | Higashi et al. | 399/69 |

FOREIGN PATENT DOCUMENTS

| | | | | |
|---|---|---|---|---|
| JP | 10-282825 | A | 10/1998 | |
| JP | 2004-194477 | A | 7/2004 | |
| JP | 2005-091814 | A | 4/2005 | |
| JP | 2006-133279 | A | 5/2006 | |
| JP | 2006-351400 | A | 12/2006 | |
| JP | 2010-085796 | A | 4/2010 | |
| JP | 2010-149451 | A | 7/2010 | |
| JP | 2010-152210 | A | 7/2010 | |
| JP | 20100152210 | * | 7/2010 | G03G 15/20 |

* cited by examiner

FIG. 6A

Correction table A
(zero-crossing control activation method)

| | | | | | | | | | |
|---|---|---|---|---|---|---|---|---|---|
| 221 | Immediately preceding non-activation period | 0.0 seconds or longer and shorter than 0.2 seconds | 0.2 seconds or longer and shorter than 0.5 seconds | 0.5 seconds or longer and shorter than 1.0 seconds | 1.0 seconds or longer and shorter than 2.0 seconds | 2.0 seconds or longer and shorter than 5.0 seconds | 5.0 seconds or longer and shorter than ··· seconds | ··· | 600 seconds or longer (warm-up) |
| 222 | Correction coefficient | 1.00 | 1.20 | 1.35 | 1.50 | 1.80 | 2.50 | ··· | 4.20 |

FIG. 6B

Correction table B
(phase control activation method)

| | | | | | | | | | |
|---|---|---|---|---|---|---|---|---|---|
| 231 | Immediately preceding non-activation period | 0.0 seconds or longer and shorter than 0.2 seconds | 0.2 seconds or longer and shorter than 0.5 seconds | 0.5 seconds or longer and shorter than 1.0 seconds | 1.0 seconds or longer and shorter than 2.0 seconds | 2.0 seconds or longer and shorter than 5.0 seconds | 5.0 seconds or longer and shorter than ··· seconds | ··· | 600 seconds or longer (warm-up) |
| 232 | Correction coefficient | 1.00 | 1.10 | 1.20 | 1.23 | 1.30 | 1.50 | ··· | 2.10 |

FIG. 10A

Correction table C
(zero-crossing control activation method)

| Immediately preceding non-activation period | 0.0 seconds or longer and shorter than 0.2 seconds | 0.2 seconds or longer and shorter than 0.5 seconds | 0.5 seconds or longer and shorter than 1.0 seconds | 1.0 seconds or longer and shorter than 2.0 seconds | 2.0 seconds or longer and shorter than 5.0 seconds | 5.0 seconds or longer and shorter than ··· seconds | ··· | 600 seconds or longer (warm-up) |
|---|---|---|---|---|---|---|---|---|
| Correction coefficient | 1.05 | 1.25 | 1.40 | 1.55 | 1.85 | 2.55 | ··· | 4.20 |

FIG. 10B

Correction table D
(phase control activation method)

| Immediately preceding non-activation period | 0.0 seconds or longer and shorter than 0.2 seconds | 0.2 seconds or longer and shorter than 0.5 seconds | 0.5 seconds or longer and shorter than 1.0 seconds | 1.0 seconds or longer and shorter than 2.0 seconds | 2.0 seconds or longer and shorter than 5.0 seconds | 5.0 seconds or longer and shorter than ··· seconds | ··· | 600 seconds or longer (warm-up) |
|---|---|---|---|---|---|---|---|---|
| Correction coefficient | 1.03 | 1.13 | 1.23 | 1.26 | 1.33 | 1.53 | ··· | 2.10 |

IMAGE FORMING APPARATUS CAPABLE OF ACCURATELY ESTIMATING POWER CONSUMPTION LEVEL

This application is based on an application No. 2012-148653 filed in Japan, the contents of which are hereby incorporated by reference.

BACKGROUND OF THE INVENTION (1) Field of the Invention

The present invention relates to an image forming apparatus having a fixing unit, and in particular, to estimation of a power consumption level in the fixing unit.

(2) Description of the Related Art

An electrophotographic image forming apparatus such as a printer commonly has a fixing unit that includes a pressurizing roller and a fixing roller including a heater such as a halogen lamp. Such a fixing unit, when a recording sheet having an unfixed toner image formed thereon passes through a fixing nip formed between the pressurizing roller and the fixing roller by the pressurizing roller pressing against the fixing roller, heat-fixes the toner image onto the recording sheet.

Such an image forming apparatus is no exception in the demand for energy conservation growing stronger year by year. In particular, there is a demand for a structure implementable in an image forming apparatus that enables a user to accurately keep track of power consumed by the image forming apparatus.

Commonly, an image forming apparatus executes predetermined processing such as a print job while switching on and off components such as a heater included in a fixing unit and one or more motors for driving one or more photosensitive drums, rollers, etc. Here, it should be noted that components such as a motor and a heater may operate at a power consumption level (i.e., a power level) indicating greater power than a rated power level thereof, and therefore may consume more energy than regularly consumed, particularly when an inrush of a large, instantaneous current takes place upon commencement of power supply thereto (i.e., when an inrush current occurs).

When it is desired to accurately estimate an overall power consumption level of the entire image forming apparatus, such an increase in power consumption level brought about by the inrush current cannot be ignored when taking place in the heater in the fixing unit. This is since power consumed by the heater corresponds to a great proportion of power consumed by the entire image forming apparatus.

As such, it may be considered to provide the image forming apparatus with a structure where a wattmeter or the like is provided for actually measuring the increase in power consumption level brought about by the inrush current. However, the provision of such a measurement equipment to the image forming apparatus results in increased device cost.

In view of such problems, Japanese Patent Application Publication No. 2010-152210 discloses calculating the power consumption level of the heater by assuming that a certain amount of power is additionally consumed by the heater each time the heater is activated due to inflow of the inrush current to the heater and by adding a value indicating the additional power consumption to the rated power level of the heater.

By performing calculation in such a manner, the power consumption level of the heater can be estimated with higher accuracy compared to when the effect of the inrush current is not taken into consideration.

However, according to results of confirmation performed by the present inventors, the level of the inrush current flowing into the heater upon commencement of power supply differed depending upon a duration of an interval from deactivation of the heater to the activation of the heater. In fact, the present inventors determined through such confirmation that the method described in Japanese Patent Application Publication No. 2010-152210, which involves adding, each time the heater is activated, a uniform value indicating the increase in power consumption level of the heater brought about by the inrush current to the rated power level of the heater, does not enhance the accuracy of the estimation of the power consumption level of the heater by much.

SUMMARY OF THE INVENTION

In view of the problems described above, the present invention provides an image forming apparatus that enables accurate estimation of the power consumption level of the heater included in the fixing unit without having to actually measure the increase in power consumption level of the heater brought about by the inrush current.

One aspect of the present invention is an image forming apparatus having a fixing unit that includes a pressurizing member, a heating rotational body, and a heater, wherein the fixing unit adjusts a temperature of the heating rotational body by switching a state of the heater between a heating state where the heater receives power supply and a non-heating state where the heater does not receive power supply, and the fixing unit, when a recording sheet having an unfixed toner image formed thereon passes through a fixing nip formed between the heating rotational body and the pressurizing member by the pressurizing member pressing against the heating rotational body, heat-fixes the toner image onto the recording sheet, the image forming apparatus comprising: a storage unit that stores a basic power consumption level of the heater determined in advance in a situation where the heater is in the heating state and where inflow of inrush current to the heater is not occurring; an estimation unit that calculates an estimated power consumption level of the heater by (i) estimating, according to a duration of a non-heating state immediately preceding the heating state, an increase in the power consumption level of the heater, with respect to the basic power consumption level of the heater, brought about by inflow of inrush current to the heater occurring when the heater is switched from the immediately preceding non-heating state to the heating state, and (ii) adding the increase in the power consumption level of the heater to the basic power consumption level of the heater; and an output unit that outputs the estimated power consumption level of the heater.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 6A illustrates a correction table A for correcting a power consumption level of the heater when the zero-crossing control activation method is selected, and FIG. 6B illustrates a correction table B for correcting the power consumption level of the heater when the phase control activation method is selected;

FIG. 10A illustrates a correction table C for correcting the power consumption level of the beater upon activation of an image forming apparatus pertaining to embodiment 2 of the present invention or recovery from a long-period sleep state of the image forming apparatus pertaining to embodiment 2 when the zero-crossing control activation method is employed, and FIG. 10B illustrates a correction table B for correcting the power consumption level of the heater upon activation of the image forming apparatus pertaining to embodiment 2 or recovery from the long-period sleep state of the image forming apparatus pertaining to embodiment 2 when the phase control activation method is employed.

DESCRIPTION OF THE PREFERRED EMBODIMENTS (1) Embodiment 1

In the following, description is provided on an image forming apparatus pertaining to embodiment 1 of the present invention with reference to the accompanying drawings.

(1-1) Structure of Image Forming Apparatus

Figure 1:
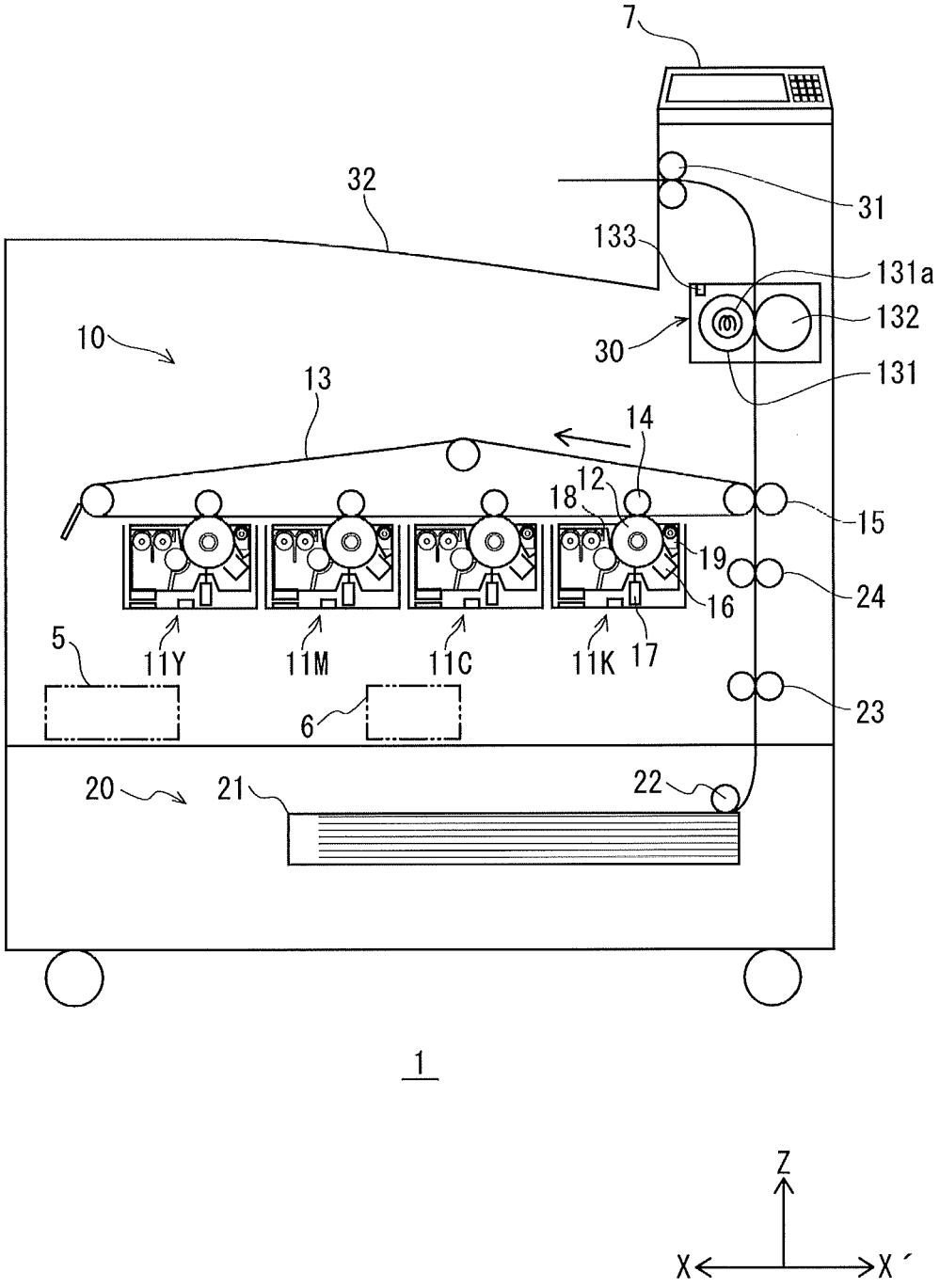
FIG. 1 is a schematic cross-sectional view illustrating a structure of an image forming apparatus pertaining to embodiment 1 of the present invention.

FIG. 1 is a schematic cross-sectional view for describing a structure of a printer that is one example of the image forming apparatus pertaining to embodiment 1 of the present invention.

A printer 1 includes: an image forming unit 10; a paper feeding unit 20; a fixing unit 30; a power source unit 5; a control unit 6; and an operation panel 7.

The paper feeding unit 20 includes: a storage tray 21; a feed roller 22; a separation roller pair 23; a timing roller pair 24; and a discharge roller 31.

The storage tray 21 is a box for accommodating recording sheets.

The feed roller 22 contacts the topmost recording sheet in the storage tray 21 and feeds the recording sheet onto a path along which recording sheets are transported in the printer 1 (hereinafter referred to as a sheet transport path).

The separation roller pair 23 is constituted of a driving roller and a driven roller that is driven by the driving roller. The driving roller and the driven roller form a separation nip by contacting one another. Further, a torque limiter is attached to the driven roller, whereby a force in a direction opposite the direction in which the recording sheet is transported along the sheet transport path is exerted on the recording sheet.

The torque limiter prevents double-fed recording sheets from being transported further along the transport path, by separating the double-fed recording sheets from one another. Here, the term "double-fed recording sheets" is used to refer to a state where another recording sheet is carried along by the recording sheet being transported along the sheet transport path.

The timing roller pair 24 sends out the recording sheet further downstream along the sheet transport path at a timing instructed by the control unit 6.

The image forming unit 10, as illustrated in FIG. 1, includes imaging units 11Y, 11M, 11C, and 11K respectively corresponding to the colors yellow (Y), magenta (M), cyan (C), and black (K). In addition, the image forming unit 10 includes: an intermediate transfer belt 13; a second transfer roller 15; and a plurality of first transfer rollers 14 each facing a photosensitive drum 12 built into a corresponding one of the imaging units 11Y, 11M, 11C, and 11K.

As illustrated in FIG. 1, the imaging units 11Y, 11M, 11C, and 11K are disposed in the stated order along the intermediate transfer belt 13 with a predetermined interval between one another.

For instance, the imaging unit 11K, in addition to including a corresponding photosensitive drum 12, includes: a charger 16; an exposure unit 17; a developer 18; and a cleaner 19. In the imaging unit 11K, the charger 16, the exposure unit 17, the developer 18, and the cleaner 19 are disposed along a circumference of the corresponding photosensitive drum 12.

Note that since the structure of each of the imaging units 11Y, 11M, and 11C is similar to that of the imaging unit 11K, description thereon is omitted herein.

The exposure unit 17, in each of the imaging units 11Y, 11M, 11C, and 11K, includes a lens and light-emitting elements such as laser diode elements. The exposure unit 17 obtains a drive signal from the control unit 6, emits a laser beam for exposure-scanning the corresponding photosensitive drum 12, and thereby exposure-scans the corresponding photosensitive drum 12 in a main scanning direction. Note that the drive signal obtained by the exposure unit 17 is generated by the control unit 6 according to image data acquired from an external source via a LAN, etc.

The photosensitive drum 12, in each of the imaging units 11Y, 11M, 11C, and 11K, is driven to rotate by an undepicted drive source. Further, before exposure-scanning by the exposure unit 17, residual toner on the surface of the photosensitive drum 12 is removed by the cleaner 19, and charge remaining on the surface of the photosensitive drum 12 is erased by an undepicted erase lamp. Following the removal of residual toner and charge, the surface of the photosensitive drum 12 is uniformly charged by the charger 16. When the surface of the photosensitive drum 12, now having uniform charge along an entirety thereof, is exposure-scanned by the laser beam as described above, an electrostatic latent image is formed thereon.

In each of the imaging units 11Y, 11M, 11C, and 11K, the electrostatic latent image formed on the surface of the corresponding photosensitive drum 12 undergoes developing by the developer 18 of the corresponding color. As such, a toner image of a corresponding color among the colors Y, M, C, and K is formed on the surface of the respective photosensitive drums 12.

The creation of the toner image of the corresponding color by each of the imaging units 11Y, 11M, 11C, and 11K is performed at a different timing such that the toner images formed by the respective imaging units 11Y, 11M, 11C, and 11K are transferred so as to be overlaid one on top of another at the same position of the intermediate transfer belt 13. A toner image of a given color formed on the photosensitive drum 12 included in the corresponding one of the imaging units 11Y, 11M, 11C, and 11K is transferred onto the intermediate transfer belt 13 by electrostatic force applied by the corresponding first transfer roller 14. By multi-transfer of toner images onto the immediate transfer belt 13 being performed as described above, a full-color toner image is formed on the intermediate transfer belt 13.

The toner images overlaid one on top of another on the intermediate transfer belt 13 are then carried to a second transfer position by the rotation of the intermediate transfer belt 13.

In the meantime, the recording sheet is transported towards the second transfer position from the paper feeder 20 via the timing roller pair 24. Here, note that the timing at which the recording sheet is supplied to the second transfer position is adjusted so as to coincide with the timing at which the toner images on the intermediate transfer belt 13 arrive at the second transfer position. When arriving at the second transfer position, the toner images on the intermediate transfer belt 13 are transferred onto the recording sheet (i.e., a second transfer is carried out) by electrostatic force resulting from voltage applied to the second transfer roller 15. Following the second transfer, the recording sheet having the toner images transferred thereon is transported to the fixing unit 30.

The fixing unit 30 includes: a fixing roller 131 having a built-in heater 131*a;* and a pressurizing roller 132. The fixing roller 131 and the pressurizing roller 132 are disposed so as to be in parallel alignment with respect to each other and so as to press against each another. Due to the fixing roller 131 and the pressurizing roller 132 being disposed in such a manner, a fixing nip is formed between the fixing roller 131 and the pressurizing roller 132.

Here, the pressurizing roller 132 is driven, for instance, by an undepicted drive source, and the fixing roller 131 is caused to passively rotate when the pressurizing roller 132 rotates.

The heater 131*a* is a halogen lamp and heats the fixing roller 131 from inside. The fixing roller 131 is heated mainly due to the radiant heat generated and output by the heater 131*a*.

In addition, the fixing unit 30 is also provided with a temperature sensor 133 that detects a surface temperature of the fixing roller 131.

When the recording sheet passes through the fixing nip, the toner images having been transferred onto the surface of the recording sheet are heat-fixed onto the recording sheet by application of heat and pressure. Following the heat-fixing, the recording sheet is discharged onto the discharge tray 32 via the discharge roller pair 31.

The power source unit 5 is, for instance, connected to a commercial AC power source supplying AC voltage of 100 V, 50 Hz and supplies electric power (hereinafter referred to simply as "power") to the heater 131*a*, an undepicted drive source, etc.

The operation panel 7 includes a numeric keypad, a touch panel, etc., receives instructions from an operator of the printer 1, and displays information for the operator to see.

The control unit 6 has overall control over the image forming unit 10, the paper feeder 20, the fixing unit 30, etc. The control performed by the control unit 6 includes driving an undepicted drive source at a predetermined timing The control unit 6 also performs conventional temperature adjustment control of the heater 131*a* according to detection results of the temperature sensor 133. More specifically, the control unit 6 activates the heater 131*a* when the temperature detected by the temperature sensor 133 is equal to or lower than a predetermined target temperature and deactivates the heater 131*a* when the detected temperature exceeds the predetermined target temperature.

In addition, the control unit 6 included in the printer 1 pertaining to the present embodiment estimates a power consumption level of the entire printer 1 and causes the operation panel 7 to display information such as a maximum power consumption level of the printer 1 for each month. The control performed by the control unit 6 is described in detail later in the present disclosure.

(1-2) Configuration of Power Source Unit and Control Unit

Figure 2:
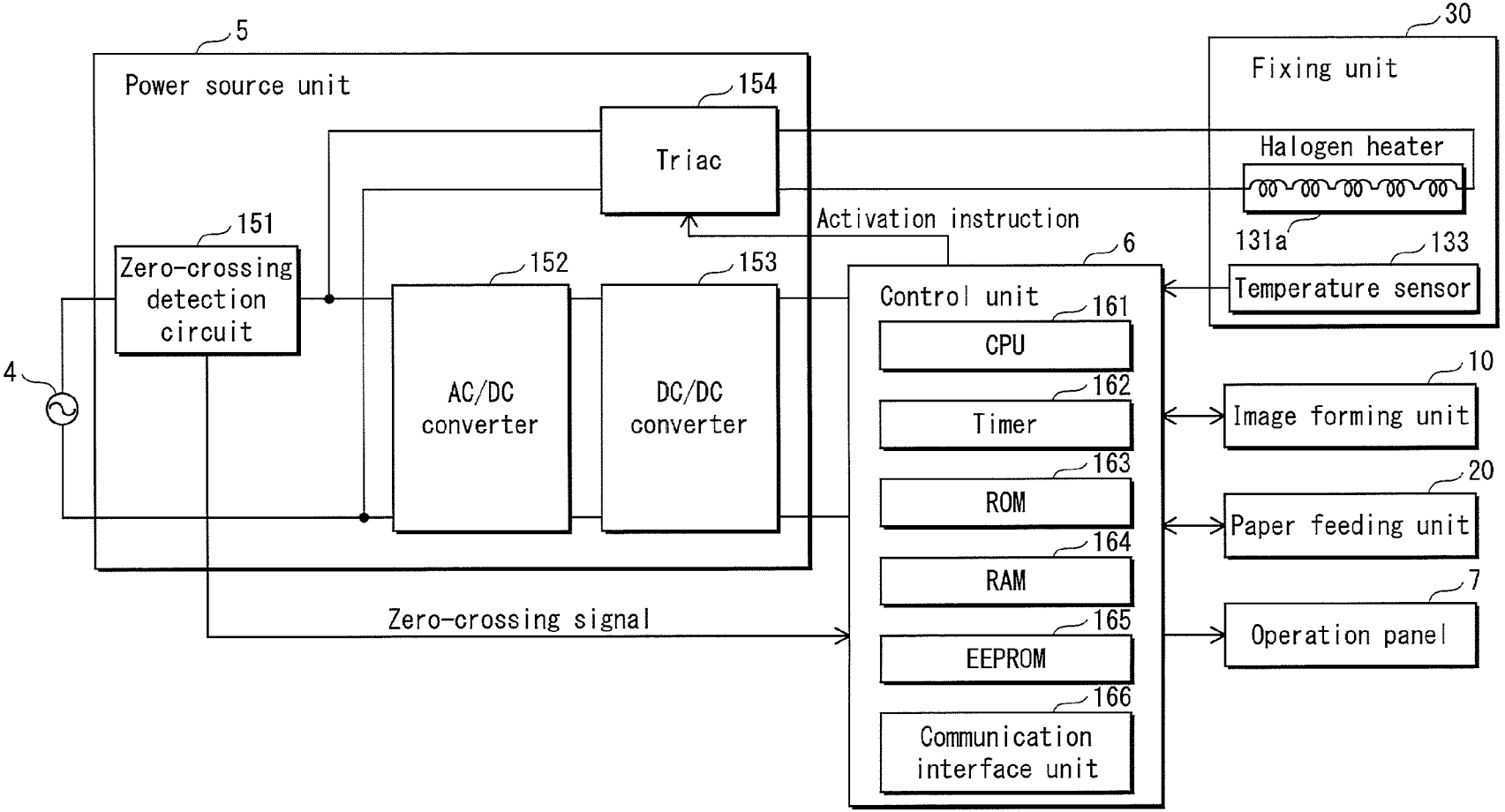
FIG. 2 is a block diagram illustrating a. control unit of the image forming apparatus pertaining to embodiment 1 and constituent elements of the image forming apparatus pertaining to embodiment 1 that are controlled by the control unit.

FIG. 2 illustrates a configuration of the power source unit 5 and the control unit 6 in the printer 1, and also illustrates a relationship between the control unit 6 and the main constituent elements that are controlled by the control unit 6.

The power source unit 5 includes: a zero-crossing detection circuit 151; an AC/DC converter 152; a DC/DC converter 153; and a triac 154.

The zero-crossing detection circuit 151, when detecting that voltage output from a commercial AC power source 4 equals zero, outputs a signal (hereinafter referred to as a zero-crossing signal) indicating that the voltage output from the commercial AC power source 4 has equaled zero to the control unit 6.

The AC/DC converter 152 converts AC voltage into DC voltage.

The DC/DC converter 153 coverts DC voltage output from the AC/DC converter 152 to DC voltage having reduced voltage and supplies the DC voltage thus converted to the control unit 6.

The triac 154 controls the amount of power supply to the heater 131*a* by opening or closing a power supply path in accordance with an activation signal output by the control unit 6. More specifically, the triac 154, when not conducting, closes the power supply path, while the triac 154, when conducting, functions as a short circuit and completes the power supply path.

Here, note that although undepicted in FIG. 2, the power source unit 5 has a plurality of additional triacs similar to the traic 154, and thereby supplies power to drive sources (undepicted) for the photosensitive drums 12, the rollers, etc., included in the printer 1.

The control unit 6 includes, as main constituent elements thereof, a central processing unit (CPU) 161, a timer 162, a read only memory (ROM) 163, a random access memory (RAM) 164, an electronically erasable and programmable read only memory (EEPROM) 165, and a communication interface (I/F) unit 166, The RAM 164 is a volatile memory that functions as a work area during execution of one or more programs by the CPU 161.

The timer 162 measures time according to instructions from the CPU 161.

The ROM 163 stores therein control programs that execute control related to the execution of printing and heater power estimation as described in detail later in the present disclosure.

The EEPROM 165 is a non-volatile memory that functions as an area to which the CPU 161 stores data.

The communication I/F unit 166 is an interface, such as a LAN card and a LAN board, for connecting to a LAN.

The CPU 161 executes conventional operations such as a warm-up operation and a print operation by executing the control programs stored in the ROM 163. Further, in addition to executing such conventional operations, the CPU 161 also performs, in accordance with a signal output from the temperature sensor 133 of the fixing unit 30, a conventional temperature adjustment control of maintaining the surface temperature of the fixing roller 131 at a predetermined target temperature by outputting, to the triac 154, an activation signal for activating the heater 131*a* provided in the fixing roller 131.

When causing the heater 131*a* to activate, the CPU 161 outputs a signal (hereinafter referred to as a heater activation signal) instructing the triac 154 to complete the power supply path by functioning as a short circuit. While the CPU 161 is outputting the heater activation signal, voltage from the commercial AC power source 4 is applied to the heater 131*a*.

Here, note that in the printer 1, two different activation methods are employed as activation methods for activating the heater 131*a*, namely a zero-crossing control activation method and a phase control activation method, and the CPU 161 activates the heater 131*a* according to one of the two activation methods having been selected by a user via the operation panel 7. The two activation methods as described above are employed in order to reduce the level of the inrush current occurring immediately following the activation of the heater 131*a* and to prevent counter electromotive force occurring upon deactivation of the heater 131*a*.

In further addition to the above, the CPU 161 pertaining to the present embodiment executes processing of estimating a power consumption level of the heater 131*a* and an energy consumption amount (i.e., a total amount of energy consumed within a given time period) of the heater 131*a* (hereinafter referred to as "heater power estimation"), and further, executes processing of estimating a power consumption level of the entire printer 1 and an energy consumption amount of the entire printer 1. Such processing is described in detail later in the present disclosure.

In the following, description is provided on the activation methods of the heater 131*a*.

(1-3) Activation Methods of Heater

Figure 3:
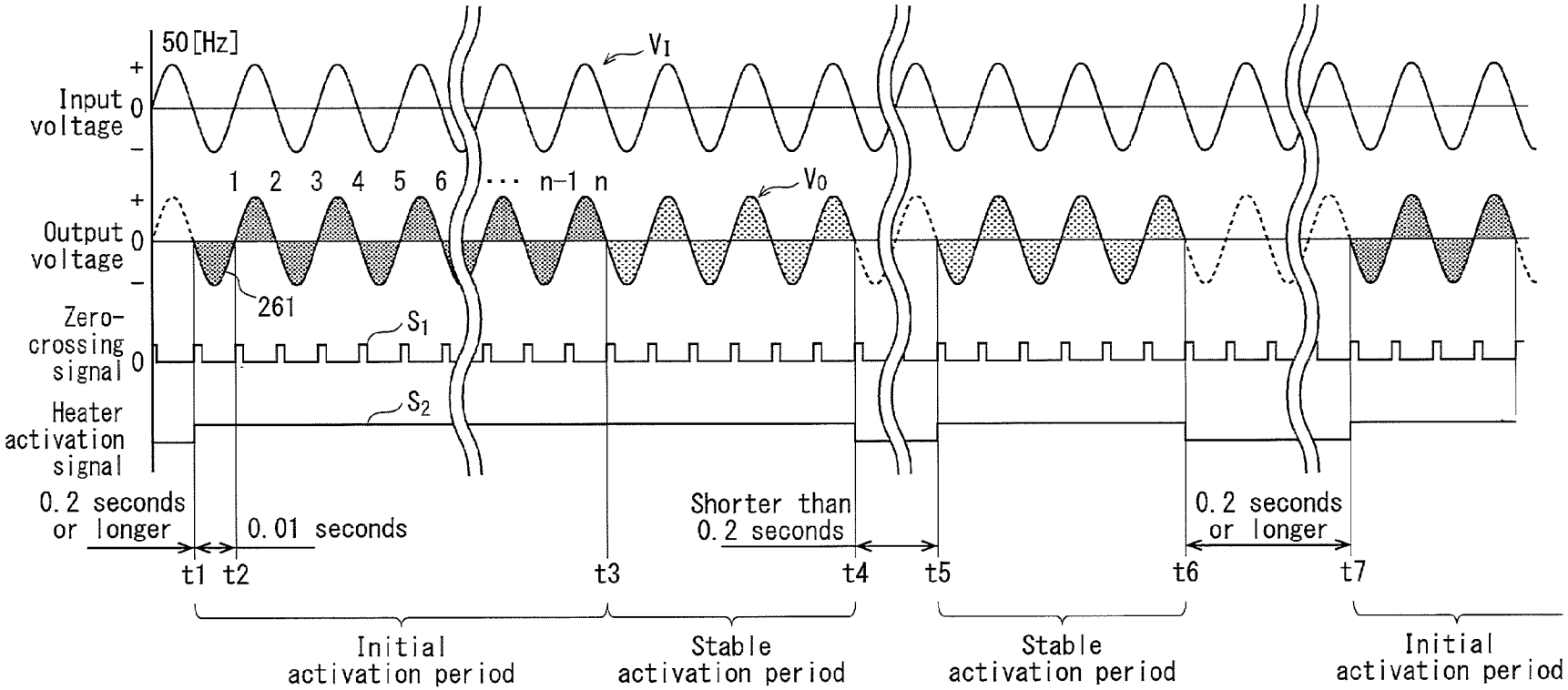
FIG. 3 is a timing chart illustrating a relationship, in the image forming apparatus pertaining to embodiment 1, between an input voltage of a triac of the image forming apparatus, an output voltage of the triac, a zero-crossing signal, and a heater activation signal when a zero-crossing control activation method is employed.

FIG. 3 is a timing chart that explains the zero-crossing control activation method. More specifically, FIG. 3 illustrates a relationship between a voltage $V_I$ input to the triac 154, a voltage $V_O$ output from the triac 154, a zero-crossing signal $S_1$ output from the zero-crossing detection circuit 151, and a heater activation signal $S_2$.

When the zero-crossing control activation method is selected, the CPU 161, when determining that the heater 131*a* is to be activated in the process of the above-described temperature adjustment control, commences output of the heater activation signal $S_2$ to the triac 154 at a time point at which the zero-crossing signal $S_1$ is subsequently output from the zero-crossing detection circuit 151 (e.g., time point t1). On the other hand, when determining that the heater 131*a* is to be deactivated, the CPU 161 terminates the output of the heater activation signal $S_2$ to the triac 154 at a time point (e.g., time point t4) at which the zero-crossing signal $S_1$ is subsequently output from the zero-crossing detection circuit 151.

According to the zero-crossing control activation method, the voltage applied to the heater 131*a* rises (falls) starting from 0 V in accordance with an AC voltage waveform. As such, the current flowing into the heater 131*a* rises (falls) at a moderate rate, whereby the inflow of inrush current to the heater 131*a* is suppressed.

In addition, according to the zero-crossing control activation method, the power supply to the heater 131*a* is terminated when the voltage applied to the heater 131*a* is 0 V. As such, the generation of counter electromotive force is prevented.

Figure 4:
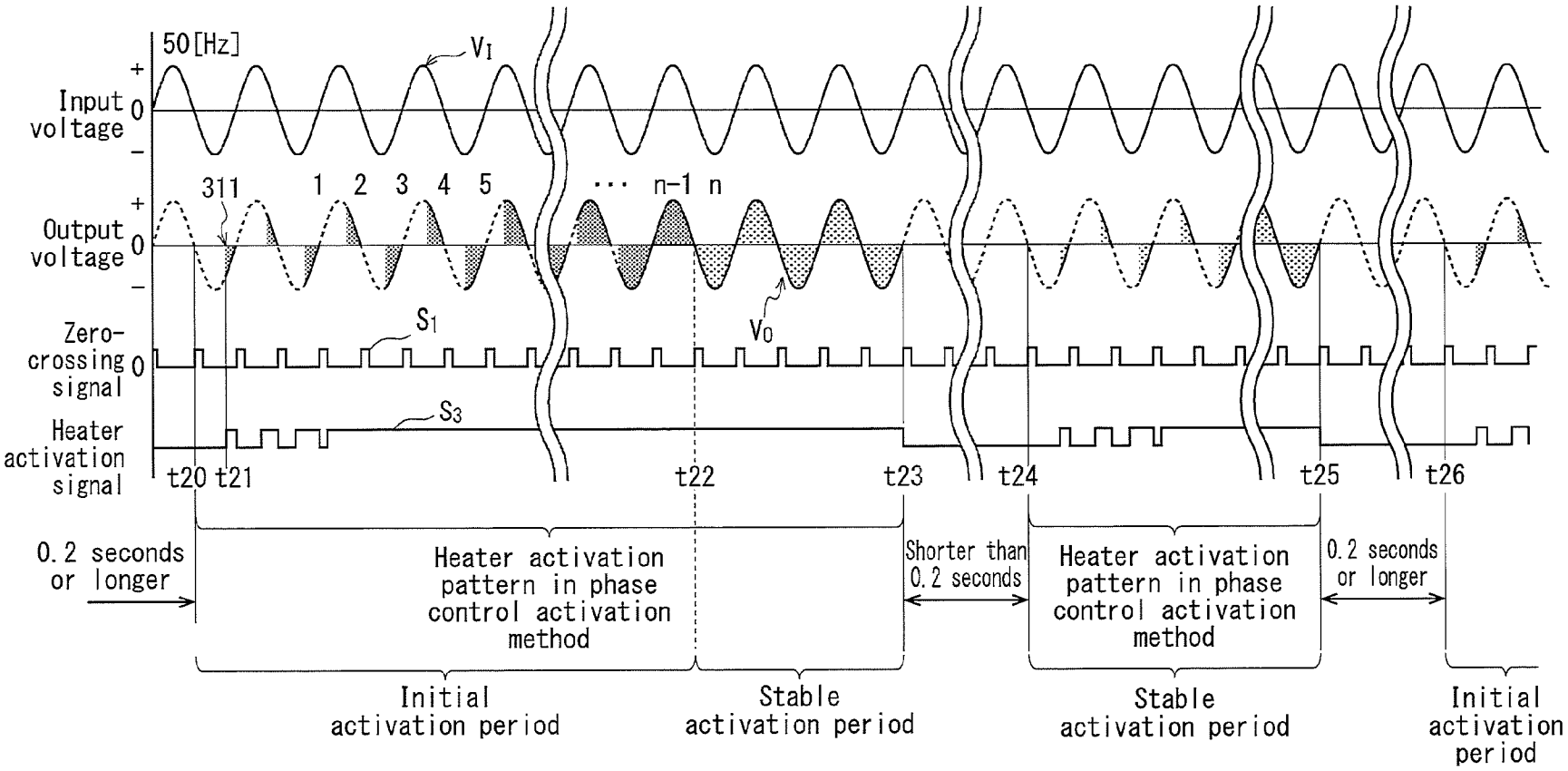
FIG. 4 is a timing chart illustrating a relationship, in the image forming apparatus pertaining to embodiment 1, between the input voltage of the triac, the output voltage of the triac, the zero-crossing signal, and the heater activation signal when a phase control activation method is employed.

FIG. 4 is a timing chart that explains the phase control activation method. More specifically, FIG. 4 illustrates a relationship between the voltage $V_1$ input to the triac 154, the voltage $V_O$ output from the triac 154, the zero-crossing signal $S_1$ output from the zero-crossing detection circuit 151, and a heater activation signal $S_3$.

When the phase control activation method is selected, the CPU 161, when determining that the heater 131*a* is to be activated in the process of the temperature adjustment control, commences output of the heater activation signal $S_3$ to the triac 154 at a time point at which the zero-crossing signal $S_1$ is subsequently output from the zero-crossing detection circuit 151 (e.g., time point t20). Further, for a period of for instance 70 ms (e.g., t20 to t22), the CPU 161 outputs the heater activation signal $S_3$ to the triac 154 such that a conduction phase angle (time corresponding to "ON" state) during which the triac 154 conducts increases in a step-like manner until a duty ratio reaches 100% from 0%.

When determining that the heater 131*a* is to be deactivated, similar as when the zero-crossing control activation method is selected, the CPU 161 terminates the output of the heater activation signal $S_3$ to the triac 154 at a time point at which the zero-crossing signal $S_1$ is subsequently output from the zero-crossing detection circuit 151 (e.g., time point t23).

As such, when the phase control activation method is employed, the power supply to the heater 131*a* is terminated when the voltage applied to the heater 131*a* is 0 V, similar as when the zero-crossing control activation method is employed. As such, the generation of counter electromotive force is prevented.

Here, note that when the phase control activation method is employed, the operations involved during a period from the commencement of the output of the heater activation signal $S_3$ to the termination of the output of the heater activation signal $S_3$ (e.g., in FIG. 4, the period between time point t20 and time point t23 and the period between time point t24 and time point t25), which includes the transition from intermittent output of the heater activation signal $S_3$ to continuous output of the heater activation signal $S_3$, are considered as constituting a sequence of heating operations for activating the heater 131*a*. Therefore, the state of the heater 131*a* during this period (hereinafter referred to as a "heating period") is hereinafter referred to as a "heating state". Note that the heating state includes the state of the heater 131*a* when the output of the heater activation signal $S_3$ to the heater 131*a* is intermittently suspended.

When the zero-crossing control activation method is employed, the heater 131*a* is considered to be in the heating state while the heater activation signal $S_2$ is being output from the triac 154 (e.g., in FIG. 3, the period between time point t1 and time point t4 and the period between time point t5 and time point t6).

Further, in both activation methods, the state of the heater 131*a* when not in the heating state is hereinafter referred to as a "non-heating" state.

When the phase control activation method is employed, the conduction phase angle of the triac 154 gradually increases in units of half-waves upon commencement of the activation of the heater 131*a*. Therefore, the amount by which the current flowing into the heater 131*a* changes is relatively small, and also, the current flowing into the heater 131*a* changes at a relatively short cycle. As such, the occurrence of the inrush current can be suppressed to a greater extent compared to when the zero-crossing control activation method is employed, whereby the generation of flickers can be suppressed.

Note that here, the term "flickers" refers to undesirable phenomena, such as flickering of an illumination apparatus connected to the commercial AC power source 4, brought about by a rapid change in AC power voltage supplied from the commercial AC power source 4. Such a rapid change in the AC power voltage is brought about due to a change in a load current of the printer 1, and impedance characteristics of the commercial AC power source 4, a power distribution network of the installation site of the printer 1, etc.

In addition, when the phase control activation method is employed, the power supply to the heater 131*a* can be controlled in units of half-waves. Hence, the heater 131*a* responds more quickly to the temperature adjustment control performed compared to when the zero-crossing control activation method is employed. As such, the phase control activation method has an advantage that temperature ripple of the heater 131*a* can be reduced.

The phase control activation method, at the same time as having advantages such as described above, also has certain disadvantages. That is, as described above, the heater 131*a* is activated at an arbitrary phase angle within a half-wave of the AC voltage according to the phase control activation method. This brings about an instantaneous change in the current supplied to the heater 131*a*, which results in the generation of harmonic current distortion and/or switching noises (abnormal noises).

The circumstances being as such, the user or the serviceman of the printer 1 selects, via the operation panel 7, one of the two activation methods described above that he/she assumes to be more suitable for the usage environment of the printer 1.

(1-4) Estimation of Power Consumption Level and Energy Consumption Amount of Printer The CPU 161 estimates a maximum power consumption level of the entire printer 1 and an energy consumption amount of the entire printer 1 for each month and displays the results of the estimation on the operation panel 7.

In order to be able to perform the above-described estimation of the maximum power consumption level and the energy consumption amount of the entire printer 1, the CPU 161 needs to be capable of keeping track of the power consumption level of each device included in the printer 1.

Basically, the CPU 161 assumes that a given device consumes power corresponding to the rated power level of the device when power is supplied thereto.

Further, the CPU 161 calculates an energy consumption amount of the given device by causing the timer 162 to measure the amount of time during which power has been supplied to the device within a given period, and by multiplying the amount of time so measured by a value indicating the rated power level of the device, which is stored in the ROM 163. Further, the CPU 161 adds the energy consumption amount for the given period so calculated to a total energy consumption amount stored in the EEPROM 165.

The total energy consumption amount of the given device for each month is stored in a table stored in the EEPROM 165, whereby a record can be kept of the energy consumption amount of the device in units of months.

In the meantime, here, it should be noted that either one of the two heater activation methods described above can reduce the level of the inrush current occurring but cannot completely suppress the occurrence of the inrush current.

In addition, it should also be noted that, since activation and deactivation of the heater 131*a* is repeated frequently, the increase in power consumed by the heater 131*a* due to the occurrence of the inrush current (hereinafter referred to as an "increased power consumption" of the heater 131*a*) is greater than observed in the other devices included in the printer 1, and hence, needs to be taken into consideration when estimating the power consumption level of the heater 131*a*. In other words, if the estimation of the power consumption level of the heater 131*a* were to be performed in the manner described above with respect to the other devices included in the printer 1, the estimated power consumption level of the heater 131*a* would differ from the actual power consumption level of the heater 131*a*.

In view of this, the printer 1 pertaining to the present embodiment performs processing of estimating the power consumption level of the heater 131*a* by first calculating the above-described increased power consumption of the heater 131*a*, and by then adding the increased power consumption so estimated to the rated power level of the heater 131*a*. This processing is hereinafter referred to as "heater power estimation".

(1-5) Inrush Current and Power Consumption Level

The present inventors have conducted an experiment as described in the following for each of the two activation methods. In the experiments, the present inventors used a wattmeter to measure an average power consumption level of the heater 131*a* within each of two periods, namely an initial activation period and a stable activation period. The initial activation period refers to a period from the commencement of the activation of the heater 131*a* to a point where the inrush current occurring upon the activation of the heater 131*a* substantially disappears. The stable activation period refers to a period following the initial activation period, during which the heater 131*a* is kept in activation state.

Here, note that the power consumption level of the heater 131*a* can be calculated by first integrating a momentary power value, which is a product of a momentary voltage value and a momentary current value, within a predetermined tune period (commonly, a period corresponding to one cycle of applied voltage) to calculate the energy consumption amount of the heater 131*a* during the predetermined time period, and by dividing the energy consumption amount by the predetermined time period.

In a strict sense, the duration from the commencement of the activation of the heater 131*a* to the point where the inrush current substantially disappears, or that is, the duration of the initial activation period changes according to activation conditions of the heater 131*a* such as a duration of an interval from deactivation of the heater 131*a* to the activation of the heater 131*a*.

However, the printer 1, when actually implemented, does not include any equipment such as an ammeter and a wattmeter capable of detecting the occurrence of the inrush current. As such, the printer 1 is not capable of detecting the actual duration of the initial activation period.

In view of this, the present inventors have conducted the above-described experiment for each of the two activation methods of the heater 131*a* in advance to measure the chronological change in current flowing into the heater 131*a* for different activation conditions of the heater 131*a*, and thereby determined the amount of time that was required for the inrush current to substantially disappear in each of the activation conditions. And further, for each of the two activation methods, the present inventors regarded the greatest one among the different amounts of time so measured as the initial activation period of the heater 131*a*, which is applied in common to all activation conditions of the heater 131*a* when estimating the power consumption level of the heater 131*a*.

Note that the term "initial activation period" appearing in the following description refers to an initial activation period having been set in such a manner.

According to the above-described experiments, it was confirmed that the heater 131*a* consumes power equivalent to the rated power level thereof during the stable activation period.

In addition, it was also found that the increase in the amount of power consumed by the heater 131*a* brought about by the occurrence of the inrush current upon commencement of the activation of the heater 131*a*, or that is, the increased power consumption of the heater 131*a* increases as a duration increases of a period (hereinafter referred to as an "immediately preceding non-activation period") during which the heater 131*a* is in a non-activation state immediately preceding the commencement of power supply to the heater 131*a*.

Based on this finding, the present inventors made an assumption that the power consumption level of the heater 131*a* can be estimated accurately by determining the relationship between durations of the immediately preceding non-activation period and values of the increased power consumption of the heater 131*a*, and conducted the above-described experiments.

Here, note that the above-described measurement was performed after print jobs were executed several times in repetition following the activation of the printer 1 and the completion of warm-up of the printer 1, in order to approximate the experiment conditions to the normal usage conditions of the printer 1.

Figure 5:
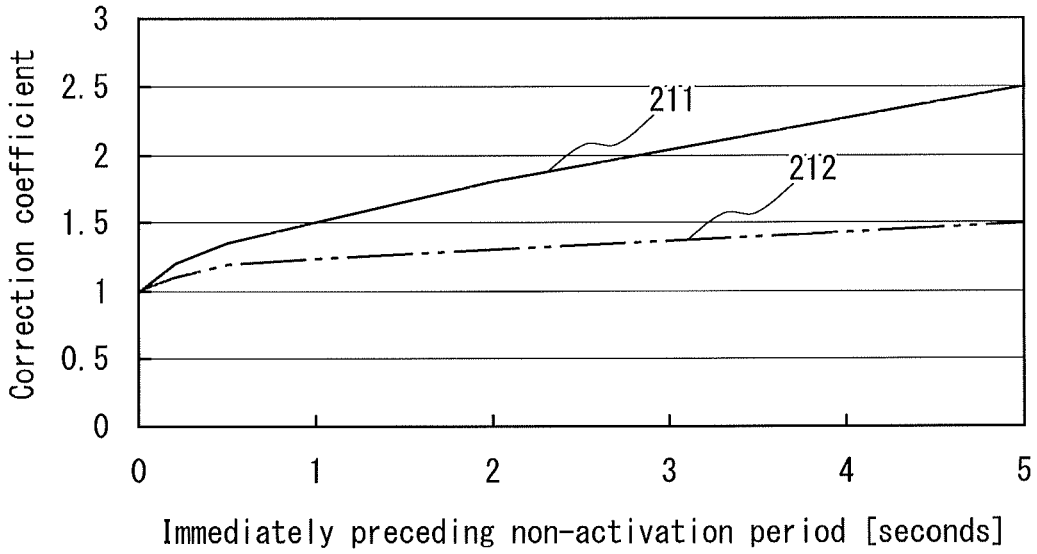
FIG. 5 illustrates a relationship between durations of an immediately preceding non-activation period and correction coefficients.

FIG. 5 illustrates the relationship between durations of the immediately preceding non-activation period and correction coefficients.

Here, a correction coefficient is a value that is calculated by dividing an energy consumption amount of the heater 131*a* actually measured during the initial activation period, which starts at the commencement of the activation, by an energy consumption amount of the heater 131*a* (hereinafter referred to as a "basic energy consumption amount") during the initial activation period, determined in advance under the conditions described in the following where the inrush current does not substantially occur upon commencement of the activation of the heater 131*a* (hereinafter referred to as "stable activation conditions").

In specific, the present inventors found through the above-described experiments that the inrush current does not substantially occur when the heater 131*a* (i) is continuously activated for a relatively long period, (ii) is then deactivated while the temperature of the heater 131*a* is sufficiently high, and (iii) is then reactivated within 0.2 seconds from deactivation. The heater 131*a*, when activated according to the stable activation conditions, is activated in such a manner.

In addition, note that in the following description, a value indicating an average power consumption level of the heater 131*a* that is calculated by dividing the basic energy consumption amount by the initial activation period (time) is referred to as a "basic power consumption level" of the heater 131*a*.

When the zero-crossing control activation method is employed, the triac 154 conducts at a duty ratio of 100% from the commencement of the activation of the heater 131*a*. Due to this, when the heater 131*a* is activated according to the stable activation conditions, the basic power consumption level of the heater 131*a* is substantially equivalent to the rated power level of the heater 131*a*. Therefore, the basic energy consumption amount of the heater 131*a* during the initial activation period is substantially equivalent to an energy consumption amount that can be calculated by multiplying the rated power level of the heater 131*a* by the initial activation period (time).

In contrast to this, when the heater 131*a* is employed, the basic energy consumption amount of the heater 131*a*, when actually measured, indicates a smaller value than an energy consumption amount that can be calculated by multiplying the rated power level of the heater 131*a* by the initial activation period (time), and in addition, the basic power consumption level of the heater 131*a* indicates a smaller value than the rated power level of the heater 131*a*.

This is since, when the phase control activation method is employed, the conduction phase angle during which the triac 154 conducts (time corresponding to "ON" state) increases in a step-like manner until the duty ratio reaches 100% from 0%. As such, during the initial activation period, the power consumption level of the heater 131*a* also increases in a step-like manner.

In FIG. 5, the curve indicated by reference sign 211 is a graph indicating the relationship between durations of the immediately preceding non-activation period and the correction coefficients in a case where the heater 131*a* is activated according to the zero-crossing control activation method, and, the curve indicated by reference sign 212 is a graph indicating the relationship between durations of the immediately preceding non-activation period and the correction coefficient in a case where the heater 131*a* is activated according to the phase control activation method.

As illustrated in FIG. 5, the correction coefficients increase in value as the duration of the immediately preceding non-activation period increases, regardless of whether the zero-crossing control activation method or the phase control activation method is employed.

In addition, it should also be noted that this tendency is more prominent when the zero-crossing control activation method is employed compared to when the phase control activation method is employed.

This is since, as described above, the phase control activation method suppresses the occurrence of the inrush current to a greater degree compared to the zero-crossing control activation method.

The reason why such a relationship as described above exists between the duration of the immediately preceding non-activation period and the power consumption level of the heater 131*a* is assumed to be since the heater 131*a* has positive temperature coefficient (PTC) characteristics. That is, a longer immediately preceding non-activation period results in the temperature of the heater 131*a* falling to a lower temperature due to heat radiation, which further results in a decrease in the resistance of the heater 131*a*. When the resistance of the heater 131*a* decreases in such a manner, a great current flows through the heater 131*a* upon commencement of power supply thereto.

Here, note that in FIG. 5, for each of the activation methods, illustration is provided of the correction coefficients when the immediately preceding non-activation period has a duration within a range of zero to five seconds. However, illustration is not provided in FIG. 5 of the correction coefficients for durations of the immediately preceding non-activation period of five seconds or greater.

The ROM 163 in the printer 1 pertaining to the present invention stores therein: the rated power level of the heater 131*a;* the rated power level of each device in the printer 1 other than the heater 131*a*; a correction table A; a correction table B; and the basic power consumption level of the heater 131*a* for each of the zero-crossing control activation method and the phase control activation method.

Each of the basic power consumption levels of the heater 131*a* stored in the ROM 163 is a value that has been obtained by conducting the above-described experiment for the corresponding activation method. Here, it should be noted that, as described above, the basic power consumption level of the heater 131*a* when the zero-crossing control activation method is employed is substantially equivalent to the rated power level of the heater 131*a*.

FIG. 6A illustrates the specific contents of the correction table A, and FIG. 6B illustrates the specific contents of the correction table B.

The correction table A is used for determining the correction coefficient to be used for correcting the power consumption level of the heater 131*a* when the zero-crossing control activation method is employed, and includes correction coefficients corresponding to durations of the immediately preceding non-activation period.

On the other hand, the correction table B is used for determining the correction coefficient to be used for correcting the power consumption level of the heater 131*a* when the phase control activation method is employed, and includes correction coefficients corresponding to durations of the immediately preceding non-activation period.

Note that the correction tables A and B have been prepared according to the relationship illustrated in FIG. 5 between the durations of the immediately preceding non-activation period and the correction coefficients.

As illustrated in the correction tables A and B, the correction coefficient is set to one when the immediately preceding non-activation period is shorter than 0.2 seconds, regardless of whether the zero-crossing control activation method or the phase control activation method is employed. This is since, the state of the heater 131*a* when the duration of the immediately preceding non-activation period is shorter than 0.2 seconds is almost the same as the state of the heater 131*a* in continuous activation.

That is, an assumption is made that the inflow of the inrush current to the heater 131*a* does not take place, and therefore, that the increase in power consumption level of the heater 131*a* does not take place for such a duration of the immediately preceding non-activation period.

In addition, when the duration of the immediately preceding non-activation period is 600 seconds or longer, or that is, when the heater 131*a* is activated after continuously being in the non-activation state for ten minutes or longer, the correction coefficient is set to a fixed value for each of the activation methods (namely, 4.20 for the zero-crossing control activation method and 2.10 for the phase control activation method).

The correction coefficient in such a case is set to a fixed value as described above based on the assumption that the heater 131*a* is at room temperature or near room temperature, and therefore, the resistance of the heater 131*a* has reached a minimum value.

Further, the inrush current flowing into the heater 131*a* tends to be greater when the zero-crossing control activation method is employed compared to when the phase control activation method is employed, as already described above. As such, when comparing the correction coefficients for the same duration of the immediately preceding non-activation period in the two tables, it can be seen that the correction coefficient in table A indicates a greater value than the corresponding correction coefficient in table B.

The CPU161, as already described above, performs the heater power estimation as described in the following for estimating the power consumption level of the heater 131*a* by using the correction table A, the correction table B, and the basic power consumption level of the heater 131*a*.

(1-6) Details of Heater Power Estimation

In the following, description is provided on the heater power estimation executed by the control unit 6, with reference to the flowchart in FIG. 7.

The CPU 161 determines whether or not a specification of the activation method of the heater 131*a* has been received via the operation panel 7 (Step S11).

When a specification of the activation method of the heater 131*a* has been received (Step S11: YES), the CPU 161 determines whether or not the activation method specification of which is received is the zero-crossing control activation method (Step S12). When a specification is made of the zero-crossing control activation method (Step S12: YES), the CPU 161 sets zero as the value of a flag M stored in the EEPROM 165, and sets 20 to an index value n that indicates the duration of the initial activation period (Step S13). Here, note that the flag M indicates the currently-specified activation method. In addition, correction of the power consumption level of the heater 131*a* is performed during the initial activation, period. Further, the CPU 161 determines whether or not a timing has arrived at which the heater 131*a* is to be deactivated (Step S14).

On the other hand, when a specification is made of the phase control activation method and not the zero-crossing control activation method (Step S12: NO), the CPU 161 sets one as the value of the flag M stored in the EEPROM 165, sets 70 to the index value n (Step S15), and executes the processing in Step S14 and on.

Further, when a specification of the activation method of the heater 131*a* is not received, or that is, when the activation method of the heater 131*a* has not been changed (Step S11: NO), the CPU 161 executes the processing in Step S14 and on.

As already described above, the CPU 161 determines whether or not the timing has arrived at which the heater 131*a* is to be deactivated in Step S14. When determining that the timing has arrived at which the heater 131*a* is to be deactivated (Step S14: YES), the CPU 161 terminates the output of the heater activation signal to the triac 154, and thereby deactivates the heater 131*a*. In addition, the CPU 161 causes the timer 162 to commence measurement of time (Step S16), and then determines whether or not a timing has arrived at which the heater 131*a* is to be activated (Step S17).

On the other hand, when the timing has not arrived at which the heater 131*a* is to be deactivated (Step S14: NO), the CPU 161 executes the processing in Step S17 and on (Step S14: NO).

When the timing has arrived at which the heater 131*a* is to be activated (Step S17: YES), the CPU 161 causes the timer 162 to terminate the measurement of time, obtains the time measured by the timer 162, and sets the time as a duration tf of the immediately preceding non-activation period (Step S18). In addition, the CPU 161 determines whether or not the flag M indicates zero (Step S19).

When the flag M indicates zero (Step S19: YES), the CPU 161 commences the activation of the heater 131*a* according to the zero-crossing control activation method (Step S20), and determines whether or not the duration tf of the immediately preceding non-activation period is greater than a predetermined duration ta (0.2 seconds in this example) (Step S21).

When the duration tf of the immediately preceding non-activation period is extremely short, or that is, when the duration tf of the immediately preceding non-activation period satisfies tf≤ta (threshold value), the state of the heater

131*a* is regarded as being similar to that when being continuously activated, and hence, it is regarded that the inrush current need not be taken into consideration. As such, the CPU 161 skips a later-described count-up processing (Step S23), which is to be executed at a point following the activation of the heater 131*a* when the inrush current occurs, and jumps to the later-described processing in Step S24.

On the other hand, when the flag M does not indicate zero, or that is, when the flag M indicates one (Step S19: NO), the CPU 161 commences the activation of the heater 131*a* according to the phase control activation method (Step S22), and determines whether or not the duration tf of the immediately preceding non-activation period is greater than the predetermined time period ta (Step S21).

When the duration tf of the immediately preceding non-activation period greater than the predetermined time period ta (Step S21: YES), the CPU 161 commences the count-up processing described in the following.

(1-6-1) Count-Up Processing

In the process of conducting the above-described experiments, the present inventors found that (A) the amount of time, from the commencement of the activation of the heater 131*a*, required for the power consumption level of the heater 131*a* to stabilize, or that is, the initial activation period is longer when the phase control activation method is employed compared to when the zero-crossing control activation method is employed. In addition, the present inventors also found that (B) the initial activation period becomes longer when the heater 131*a* is activated and deactivated more frequently in response to the temperature adjustment control during the initial activation period.

(A) above is considered to be a result of the longer amount of time required for the temperature of the heater 131*a* to stabilize when the phase control activation method is employed. That is, when the phase control activation method is employed, the power level of the heater 131*a* is caused to rise more gradually, and hence, the temperature of the heater 131*a* rises at a relatively moderate rate compared to when the zero-crossing control activation method is employed. Such a difference in the rate at which the power level of the heater 131*a* increases between the two activation methods is a fundamental difference between the two methods, Further, (B) above is considered to be a result of the relatively small amount of heat generated by the heater 131*a* per unit time period when the heater 131*a* is activated in an intermittent manner. When the heater 131*a* generates a relatively small amount of heat per unit time period, a greater amount of time is required until a point is reached where the amount of heat generated by the heater 131*a* and the amount of heat dissipated by the heater 131*a* are balanced. This results in a greater amount of time being required until the temperature of the heater 131*a* stabilizes, which further results in a relatively long amount of time being required until the power consumption level of the heater 131*a* stabilized.

In view of the above, when it is desired to perform correction of the power consumption level of the heater 131*a*, it is necessary to determine whether or not the present point is within the initial activation period, during which the correction of the power consumption of the heater 131*a* is to be performed. The count-up processing that is described in detail in the following is processing for making this determination.

Here, note that the contents of the count-up processing slightly differ between the zero-crossing control activation method and the phase control activation method.

First, description is provided on the contents of the count-up processing in the zero-crossing control activation method, with reference to FIG. 3.

While the heater activation signal is being output (i.e., from time point t1 and on), the CPU 161 counts up by one from an initial value of zero each time a period corresponding to a half-cycle of the input voltage $V_I$ (i.e., the period from t1 to t2 in FIG. 3, or 0.01 seconds in this example) elapses. Further, when this count-up value reaches the value n (n=20) defined in Step S13 (time point t3), the CPU 161 determines that a transition from the initial activation period to the stable activation period has taken place.

The determination is made in such a manner since, in the zero-crossing control activation method, a value indicating the magnitude of the inrush current and the time required until the inrush current diminishes is greatest when power supply to the heater 131*a* is commenced following an immediately preceding non-activation period having a duration of 600 seconds or longer, and the time required until the inrush current substantially disappears in such a case corresponds to n=20.

As already described above, when the output of the heater activation signal is suspended for a period shorter than 0.2 seconds before the stable activation period is reached, the heater 131*a* is regarded as being continuously in the activation state. However, it should be noted that the count-up processing is suspended in such a case, which results in the initial activation period being extended compared to when such a suspension does not take place.

The following explains the reasons as to why the length of the initial activation period is changed according to the total amount of time during which the heater 131*a* is in the activation state.

That is, the above-described count-up value indicates the number of waveform sections corresponding to a half-cycle of the input voltage (the darkly shaded sections), as illustrated in FIG. 3, and the number of such waveform sections indicates, to some extent, the amount of power having been supplied to the heater 131*a* and the amount of heat (temperature) provided to the heater 131*a* since the commencement of the activation of the heater 131*a*.

That is, the length of the initial activation period is changed according to the total amount of time during which the heater 131*a* is activated based on the conception that the heater 131*a* is provided with a greater amount of heat when the heater 131*a* is continuously activated for a great amount of time. When the heater 131*a* is continuously in the activation state for a longer time and more heat is provided to the heater 131*a*, the temperature of the heater 131*a* indicates a greater increase per unit time period, and the point where the amount of heat generated by the heater 131*a* and the amount of heat dissipated by the heater 131*a* is balanced is reached in a shorter time. As such, the resistance of the heater 131*a* stabilizes in a shorter amount of time, and further, the power consumption level of the heater 131*a* stabilizes in a shorter amount of time.

In addition, in FIG. 3, the period between time point t5 and time point t6 is indicated as not corresponding to the initial activation period even though the activation of the heater 131*a* is commenced at time point t5. This is since, the duration (time point t5-time point t4) of the immediately preceding non-activation period preceding this period is shorter than 0.2 seconds, and further since the period between time point t3 and time point t4 corresponds to the stable activation period, and therefore, it can be regarded that the increase in the power consumption level of the heater 131*a* brought about by the inrush current during the period between time point t5 and time point t6 need not be taken into consideration (corresponds to the processing in Step S21 in FIG. 7).

Subsequently, description is provided on the contents of the count-up processing in the phase control activation method, with reference to FIG. 4.

The basic idea underlying the count-up processing in the phase control activation method is similar to that of the count-up processing in the zero-crossing control activation method. However, the count-up processing performed in the phase control activation method differs from that performed in the zero-crossing control activation method in terms of how the count-up is performed and the above-described value n. Such differences arise from the difference in the pattern in which the heater activation signal is output in the two activation methods.

In specific, during the heating period of the heater 131*a* when the phase control activation method is employed, the CPU 161 counts up by one from an initial value of zero each time each time a total area of the waveform of the voltage applied to the heater 131*a* (the darkly shaded sections in FIG. 4) equals a multiple of an area corresponding to a half-cycle of the input voltage $V_I$.

Similar as in the zero-crossing control activation method, the above-described count-up value indicates, to some extent, the amount of power supplied to the heater 131*a* and the amount of heat (temperature) provided to the heater 131*a* since the commencement of the activation of the heater 131*a*.

Further, when this count-up value reaches the value n (n=70) defined in Step S15 (i.e., t22), the CPU 161 determines that a transition from the initial activation period to the stable activation period has taken place based on similar reasons as described above with respect to the zero-crossing control activation method.

The determination is made in such a manner since, in the phase control activation method, a value indicating the magnitude of the inrush current and the time required until the inrush current diminishes is greatest when power supply to the heater 131*a* is commenced following an immediately preceding non-activation period having a duration of 600 seconds or longer, and the time required until the inrush current substantially disappears in such a case corresponds to n=70.

Here, it should be noted that the printer 1, when actually implemented, is not capable of directly detecting the voltage applied to the heater 131*a*. However, since the pattern in which the heater activation signal is output is determined in advance, the CPU 161 is able to determine in how many seconds from the commencement of the output of the heater activation signal a timing is reached for performing the count-up described above. As such, the CPU 161 executes the count-up processing by measuring the total amount of time during which power supply to the heater 131*a* is performed from the commencement of the activation of the heater 131*a*.

Note that, as already described above, in the phase control activation method, the conduction phase angle during which the triac 154 conducts (time corresponding to "ON" state) increases in a step-like manner until the duty ratio reaches 100% from 0%. In the present embodiment, the time point at which the duty ratio reaches 100% is set to coincide with the time point at which the value n reaches 70 (70 msec).

In addition, in FIG. 4, the heating state corresponding to the period between time point t24 and time point t25 is not indicated as corresponding to the initial activation period even though the activation of the heater 131*a* is commenced at time point t. Similar as in the case of the period between time point t5 and time point t6 in FIG. 3, this is since the duration of the immediately preceding non-activation period preceding this period is shorter than 0.2 seconds, and further since the period between time point t22 and time point t23 corresponds to the stable activation period.

As such, according to the present embodiment, the initial activation period is defined by using the above-described count-up value. Further, the power consumption level of the heater 131*a* during the initial activation period is calculated by (i) calculating a correction coefficient according to the duration of the immediately preceding non-activation period by referring to the correction table corresponding to the activation method being employed, and by (ii) multiplying the correction coefficient so calculated and the basic power consumption level of the heater 131*a* for the corresponding activation method.

Referring to FIG. 7 once again, the CPU 161 subsequently performs processing of estimating a value $W_H$ indicating the power consumption level of the heater 131*a* and a value $W_H$h indicating the energy consumption amount of the heater 131*a*, or that is, the CPU 161 performs the heater power estimation (Step S24). Such processing is described in detail later in the present disclosure.

In addition, at the same time as performing the heater power estimation, the CPU 161 performs, for each device included in the printer 1 other than the heater 131*a*, processing of estimating a power consumption level and an energy consumption amount (hereinafter referred to as "regular power consumption estimation") by assuming that power corresponding to a rated power level of the corresponding device is being consumed while power is being supplied thereto.

Further, the CPU 161 calculates a value $W_{TH}$ indicating a power consumption level of the entire printer 1 by adding the value $W_H$ indicating the power consumption level of the heater 131*a* to the values indicating the power consumption levels calculated through the regular power consumption estimation. Similarly, the CPU 161 calculates a value $W_{TH}$h indicating the energy consumption amount of the entire printer 1 by adding the value $W_H$h indicating the energy consumption amount of the heater 131*a* to the values indicating the energy consumption amounts calculated through the regular power consumption estimation.

In addition, the CPU 161 calculates the maximum power consumption level of the entire printer 1 as described in the following and displays the result of the calculation on the operation panel 7 (Step S25).

That is, the CPU 161 temporary stores the value indicating the power consumption level of the entire printer 1 to the EEPROM 165. Then, when a subsequent estimation is performed of the value indicating the power consumption level of the entire printer 1 and the newly-estimated value indicating the power consumption level of the entire printer 1 is greater than the value indicating the power consumption level of the entire printer 1 stored in the EEPROM 165, the CPU 161 replaces the value indicating the power consumption level of the entire printer 1 stored in the EEPROM 165 with the newly-estimated value indicating the power consumption level of the entire printer 1. As such, the CPU 161 estimates the maximum power consumption level of the entire printer 1. Such processing is hereinafter referred to as "maximum power consumption level estimation".

The regular power consumption estimation and the maximum power consumption level estimation are performed in units of months, and the CPU 161 causes the operation panel 7 to display the results of such estimation for each month.

Figure 8:
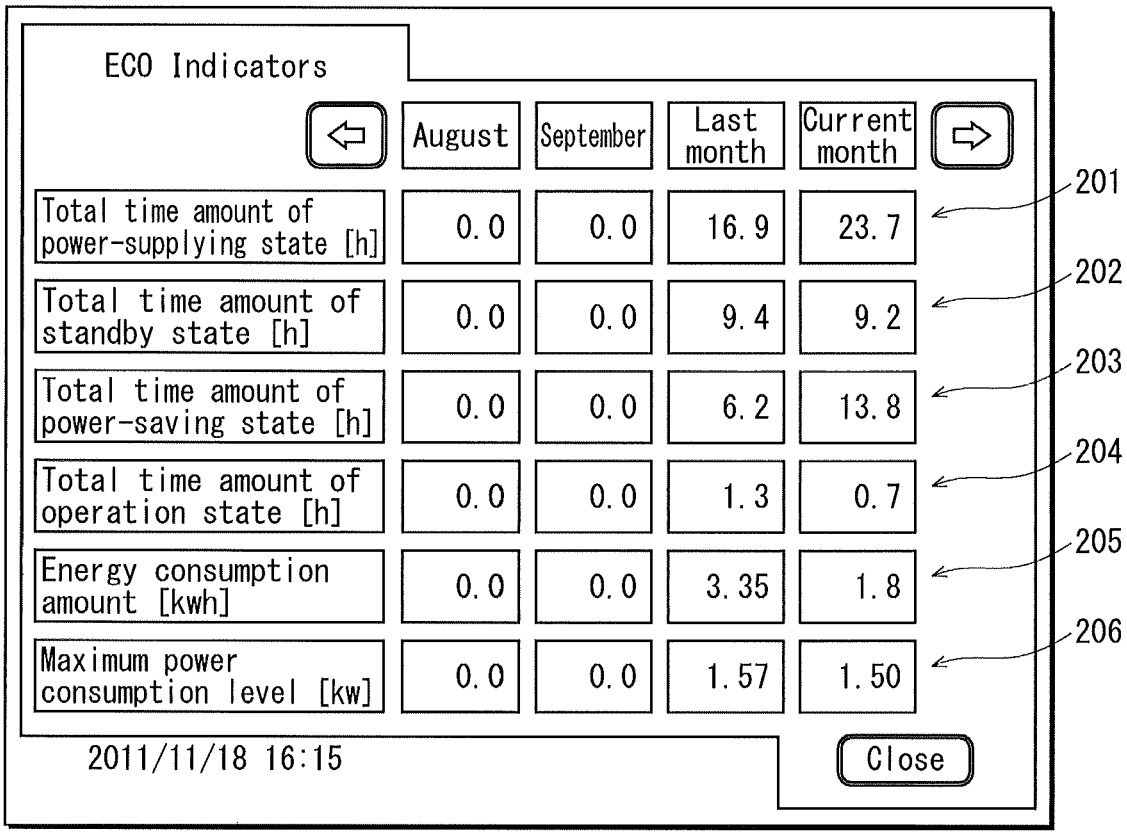
FIG. 8 illustrates an example of display performed by a display unit provided to the image forming apparatus.

FIG. 8 illustrates an example of display performed by the operation panel 7.

As illustrated in FIG. 8, a maximum power consumption level display field 206 displays the maximum power consumption level of the printer 1 for each month, for instance, from August to November, which is the current month. Note that the maximum power consumption level for the current month displayed in the maximum power consumption level display field 206 indicates the maximum power consumption level of the printer 1 up to present point. In addition, an energy consumption amount display field 205 displays the energy consumption amount of the printer 1 for each month, for instance, from August to November, which is the current month. Note that the energy consumption amount for the current month displayed in the energy consumption amount display field 205 indicates the energy consumption amount of the printer 1 up to the present point.

Note that the operation panel 7 displays, for each month, a total amount of time during which the printer 1 has been in a power-supplying state, a total amount of time during which the printer 1 has been in a standby state, a total amount of time during which the printer 1 has been in a power-saving state, and a total amount of time during which the printer 1 has been in an operation state. Each of such information is displayed in a corresponding one of fields 201, 202, 203, and 204.

Here, note that the operation state of the printer 1 is a state where the printer 1 is in the execution of a print operation. Therefore, the operation state indicates a state where the printer 1 is maintaining the surface temperature of the fixing roller 131 at the fixing temperature while causing a recording sheet to pass through the fixing nip in the fixing unit 30. Further, during the operation state of the printer 1, power is supplied to the exposure unit 17 in each of the imaging units 11Y through 11K, the undepicted drive source of the photosensitive drum 12 in each of the imaging units 11Y through 11K, the heater 131*a*, etc.

The standby state of the printer 1 is a state where the printer 1 is waiting for a print job to be executed while supplying power to the heater 131*a* and thereby maintaining the surface temperature of the fixing roller 131 at the fixing temperature.

Further, the power-saving state of the printer 1 is, for instance, a state in which the printer 1, by maintaining the surface temperature of the fixing roller 131 at an intermediate temperature between the fixing temperature and room temperature, reduces power consumption while reducing the time required for completion of a warm-up operation that is to be commenced when a print job is received.

In addition, the power-supplying state of the printer 1 as described above refers to a combination of the operation state, the standby state, and the power-saving state of the printer 1. As such, a sum of the total amount of time of the operation state, the total amount of time of the standby state, and the total amount of time of the power-saving state equals the total amount of time of the power-supplying state of the printer 1.

The amount of time during which the printer 1 is in each of the operation state, the standby state, and the power-saving state is measured by the timer 162, and values indicating such time amounts are stored to the EEPROM 165 by the CPU 161.

Returning to FIG. 7 once again, the CPU 161 subsequently determines whether or not an instruction for deactivation of the printer 1 (an instruction for turning the power of the printer 1 off) has been received (Step S26). When an instruction for deactivation of the printer 1 has been received (Step S26: YES), the CPU 161 terminates the heater power estimation.

On the other hand, when an instruction for deactivation of the printer 1 has not been received (Step S26: NO), the CPU 161 repeats the processing in Step S14 and on.

Note that, when determined in Step S17 that the timing at which the heater 131*a* is to be activated has not arrived (Step S17: NO), the CPU 161 executes the processing in Step S24 and on.

In the following, description is provided on the heater power estimation.

(1-6-2) Heater Power Estimation

Figure 7:
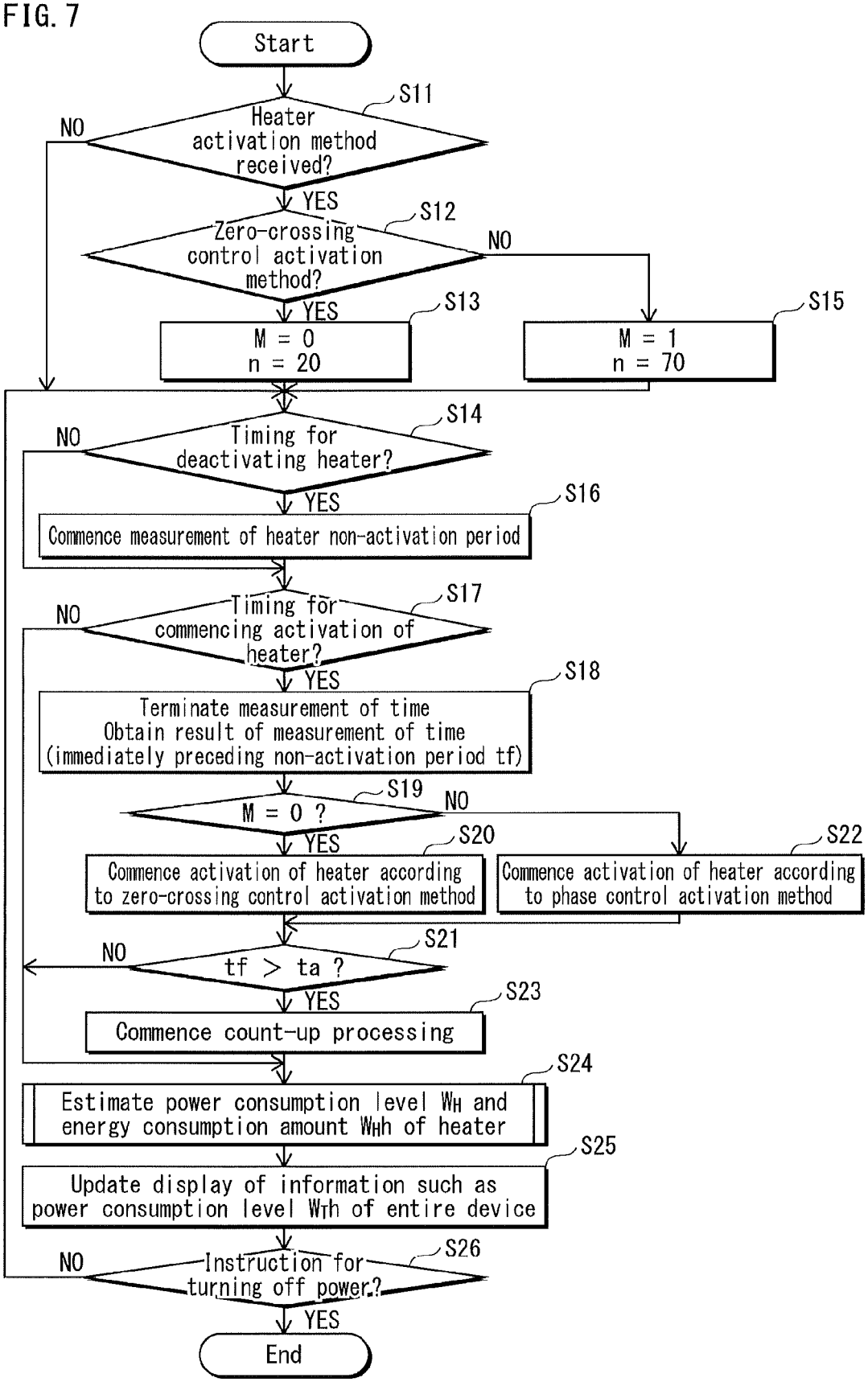
FIG. 7 is a flowchart illustrating execution procedures involved in heater power estimation executed by the control unit of the image forming apparatus.
Figure 9:
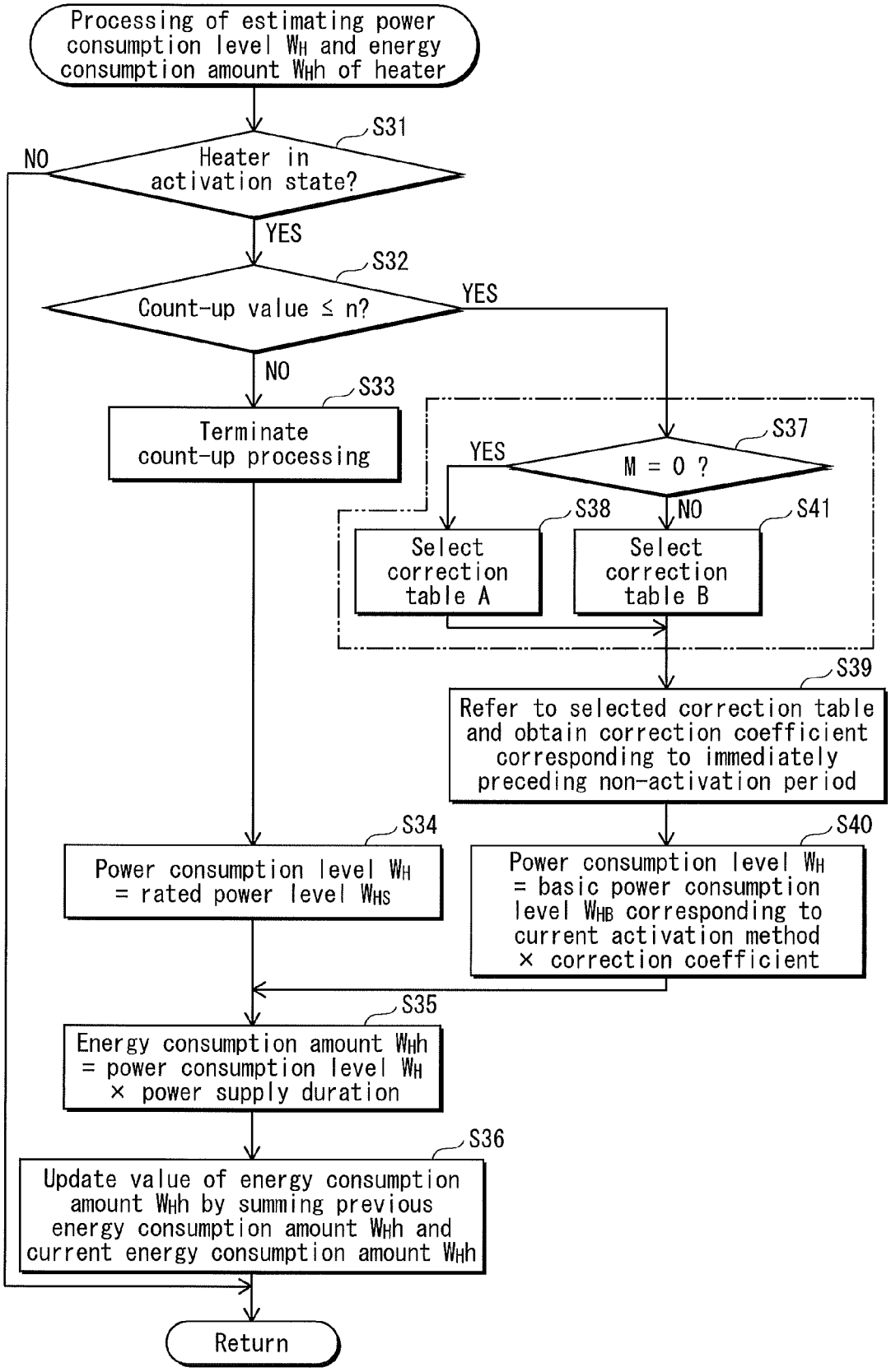
FIG. 9 is a flowchart illustrating contents of a subroutine corresponding to Step S24 in FIG. 7.

FIG. 9 is a flowchart illustrating a subroutine (the heater power estimation) corresponding to Step S24 in FIG. 7.

The CPU 161 checks the state of output of the heater activation signal and thereby determines whether or not the heater 131*a* is in activation state at the present point (Step S31).

When the heater 131*a* is not in activation state at the present point (Step S31: NO), the CPU 161 skips to the processing in Step S25 in FIG. 7.

On the other hand, when the heater 131*a* is in activation state at the present point (Step S31: YES), the CPU 161 determines whether or not the count-up value is smaller than or equal to the value n at the present point (Step S32). When the count-up value is not smaller than or equal to the value n (Step S32: NO), the CPU 161 terminates the count-up processing (Step S33), assumes that the value $W_{HS}$ indicating the rated power level of the heater 131*a* corresponds to the value $W_H$ indicating the power consumption level of the heater 131*a* (Step S34), and calculates the value $W_H$h indicating the energy consumption amount up to the present point by multiplying the value $W_H$ indicating the power consumption level and a value h indicating a duration for which power has been supplied to the heater 131*a* (Step S35). Further, the CPU 161 updates the energy consumption amount stored in the EEPROM 165 by adding the currently-calculated value $W_H$h indicating the energy consumption amount of the heater 131*a* to the previously-calculated value $W_H$h stored in the EEPROM 165 (Step S36).

On the other hand, when the count-up value is equal to or smaller than the value n (Step S32: YES), and further, when determining that the value of the flag M indicates zero (Step S37: YES), the CPU 161 selects and refers to the correction table A corresponding to the zero-crossing control activation method (Step S38) and thereby obtains a correction coefficient corresponding to the duration of the immediately preceding non-activation period (Step S39). Further, the CPU 161 regards a value $W_H$ calculated by multiplying a value $W_{HB}$ indicating the basic power consumption level of the heater 131*a* corresponding to the present activation method and the correction coefficient as the power consumption level of the heater 131*a* (Step S40), and executes the processing in Step S35 and on.

In addition, when the count-up value is equal to or smaller than the value n (Step S32: YES), and further, when determining that the value of the flag M does not indicate zero (Step S37: NO), the CPU 161 selects the correction table B corresponding to the phase control activation method (Step S41), and executes the processing in Step S39 and on.

For instance, when a heater having a rated power level of 900 W is activated according to the zero-crossing control activation method, is then deactivated and kept in the non-activation state for 0.2 seconds (i.e., the duration of the immediately preceding non-activation period is 0.2 seconds), and subsequently reactivated, the CPU 161 refers to "0.2 seconds or longer and shorter than 0.5 seconds" in a corresponding one of columns 221, which indicate durations of the immediately preceding non-activation period, in the correction table A in FIG. 6A and obtains a value 1.20 in a corresponding one of columns 222, which indicate correction coefficients corresponding to the durations.

As such, the CPU 161 performs an estimation such that the actual power consumption level of the heater is 1080 W, which is a value calculated by multiplying 900 W, which is the basic power consumption level (i.e., the rated power level) of the heater, by the correction coefficient 1.20 obtained from the correction table A.

On the other hand, when a heater having the same specifications as above is activated according to the phase control activation method, the CPU 161 refers to "0.2 seconds or longer and shorter than 0.5 seconds" in a corresponding one of columns 231, which indicate durations of the immediately preceding non-activation period, in the correction table B in FIG. 6B and obtains a value 1.10 in a corresponding one of columns 232, which indicate correction coefficients corresponding to the durations.

In the meantime, although not illustrated in FIG. 6B, the basic power consumption level of the heater, when activated according to the phase control activation method, is regarded as being 600 W.

As such, the CPU 161 performs an estimation such that the actual power consumption level of the heater is 660 W, which is a value calculated by multiplying 600 W, which is the basic power consumption level of the heater, by the correction coefficient 1.10 obtained from the correction table B.

As description has been provided up to this point, in embodiment 1, when a power consumption level of a heater is to be estimated, a correction coefficient is determined in accordance with a duration of an immediately preceding non-activation period, and the power consumption level of the heater is calculated by multiplying a power consumption level of the heater during an initial activation period by the correction coefficient. As such, the power consumption level of the heater can be accurately estimated without the use of a wattmeter or the like, which is expensive and therefore brings about an increase in device cost.

(2) Embodiment 2

(2-1) Structure of Image Forming Apparatus

In the following, description is provided on a printer that is one example of an image forming apparatus pertaining to embodiment 2 of the present invention.

A printer 1 pertaining to embodiment 2 has a structure basically similar to that of the printer 1 pertaining to embodiment 1. However, heater power estimation performed by the CPU 161 in the printer 1 pertaining to embodiment 2 differs in part from the heater power estimation performed by the CPU 161 in the printer 1 pertaining to embodiment 1. Further, the ROM 163 in the printer 1 pertaining to embodiment 2 stores, in addition to the correction tables A and B stored by the ROM 163 in the printer 1 pertaining to embodiment 2, correction tables C and D. The printer 1 pertaining to embodiment 2 differs from the printer 1 pertaining to embodiment 2 in such aspects.

In the following, constituent elements common between the printer 1 pertaining to embodiment 1 and the printer 1 pertaining to embodiment 2 are referred to by using the same reference signs and description thereon is omitted. As such, description is provided while mainly focusing on differences between the printer 1 pertaining to embodiment 1 and the printer 1 pertaining to embodiment 2.

The present inventors conducted a test and the like to evaluate the accuracy of the estimation of the power consumption level of the heater 131*a* through the execution of the heater power estimation in the printer 1 pertaining to embodiment 1.

As a result, the present inventors found that the power consumption level of the heater 131*a* estimated through the heater power estimation slightly differs from an actually-measured power consumption level of the heater 131*a* within a predetermined period from the commencement of the activation of the printer 1 in certain situations. More specifically, a difference was observed between the estimated power consumption level and the actually-measured power consumption level (i) when the activation of the heater 131*a* was commenced at a point when the printer 1 recovered from a long-period sleep state and (ii) when the activation of the heater 131*a* was commenced at a point when the printer 1 commenced a warm-up operation upon activation thereof (i.e., upon turning on of power of the printer 1). Here, note that a long-period sleep state refers to a state where the printer 1 is in a sleep mode where power supply to most devices in the printer 1 is disabled for a period of 60 minutes or longer.

The above-described predetermined period, where the difference between the power consumption levels of the heater 1 is observed was, for instance, around five minutes in the printer 1 pertaining to embodiment 1, but may differ depending upon factors such as the heat capacity of the heater 131*a* and the heat capacity of other members located around the heater 131*a*.

The above-described difference between the estimated power consumption level of the heater 131*a* and the actually-measured power consumption level of the heater 131*a* is considered as being a result of the rate of increase of the temperature of the heater 131*a* decreasing due to heat being conducted away from the heater 131*a* when the activation of the heater 131*a* is commenced according to the same activation patterns as described in embodiment 1 at a point when the printer 1 is activated or at a point when the printer 1 recovers from the long-period sleep state. In such cases, heat is conducted away from the heater 131*a* by the members located around the heater 131*a* whose temperature has not yet reached an appropriate level due to the temperature of the entire fixing unit 30 having dropped to near room temperature.

(2-2) Method for Correcting Power. Consumption Level of Heater When Activated Upon Activation of Printer or Upon Recovery of Printer from Long-period Sleep State For each of the two activation methods of the heater 131*a*, the present inventors measured the power consumption level of the heater 131*a* when activated upon the activation of the printer 1 and when activated upon the recovery of the printer 1 from the long-period sleep state, for the accuracy of the estimation of the power consumption level of the heater 131*a* decreases in such cases as already described above. Further, the present inventors prepared a correction table C for the zero-crossing control activation method and a correction table D for the phase control activation method according to values obtained through the measurement. The printer 1 pertaining to embodiment 2 is capable of estimating the power consumption level of the heater 131*a* with higher accuracy by selecting and thereby using an appropriate one of such tables when performing the correction of the power consumption level of the heater 131*a* in cases where the heater 131*a* is activated upon the activation of the printer 1 or upon the recovery of the printer 1 from the long-period sleep state.

In specific, the present inventors additionally stored the correction tables B and C corresponding to embodiment 2 to the ROM 163, and further, modified the contents of the subroutine performed in Step S24 in FIG. 7.

FIG. 10A illustrates the contents of the correction table C, and FIG. 10B illustrates the contents of the correction table D.

As can be seen when referring to FIGS. 10A and 10B, the correction coefficient is set to 1.05 when the duration of the immediately preceding non-activation period is shorter than 0.2 seconds, regardless of whether the zero-crossing control activation method or the phase control activation method is employed. That is, it is regarded that the inflow of the inrush current is not completely inhibited even when power is being continuously supplied to the heater 131*a*.

As such, in embodiment 1, the determination in Step S21 in FIG. 7 is not performed, and hence, the count-up processing corresponding to Step S23 is performed in all cases.

Further, for each of the two activation methods of the heater 131*a*, the correction coefficient corresponding to a duration of the immediately preceding non-activation period of 0.2 seconds or longer indicates a slightly greater value than the corresponding correction coefficient in embodiment 1.

This is considered as being a result of the increase of the temperature of the heater 131*a* being suppressed as described above when the activation of the heater 131*a* is commenced when the printer 1 is activated or when the printer 1 recovers from the long-period sleep state, which results in the resistance of the heater 131*a* decreasing and inrush current having a relatively great magnitude occurring upon activation of the heater 131*a*. More specifically, as described above, the increase of the temperature of the heater 131*a* is suppressed when the activation of the heater 131*a* is commenced when the printer 1 is activated or when the printer 1 recovers from the long-period sleep state since, when the activation of the heater 131*a* is commenced according to the same activation patterns as described in embodiment 1 in such cases, heat is conducted away from the heater 131*a* by the members located around the heater 131*a* whose temperature has not yet reached an appropriate level due to the temperature of the entire fixing unit 30 having dropped to near room temperature.

Note that the correction coefficients in the correction tables C and D have been calculated in a similar manner as the correction coefficients in the correction tables A and B. That is, the correction coefficients have been calculated by conducting the above-described experiments and by performing a calculation of dividing an energy consumption amount of the heater 131*a* actually measured during a corresponding one of (i) a period from the activation of the heater 131*a* to the termination of the initial activation period and (ii) a period from the recovery of the printer 1 from the long-period sleep state to the termination of the initial activation period by the basic energy consumption amount of the heater 131*a* during the initial activation period. As described above, the basic energy consumption amount of the heater 131*a* is the energy consumption amount of the heater 131*a* that is determined under a situation where the activation of the heater 131*a* is commenced according to the stable activation conditions as described above where the inrush current does not substantially occur.

Note that, when the duration of the immediately preceding non-activation period is 600 seconds or longer, or that is, when the heater 131*a* is activated after continuously being in the non-activation state for ten minutes or longer, the correction coefficient is set to a fixed value for each of the activation modes (namely, 4.20 for the zero-crossing control activation method and 2.10 for the phase control activation method), similar as in embodiment 1.

This is since the temperature of the heater 131*a* equals or is around room temperature when the duration of the immediately preceding non-activation period is 600 seconds or longer.

Figure 11:
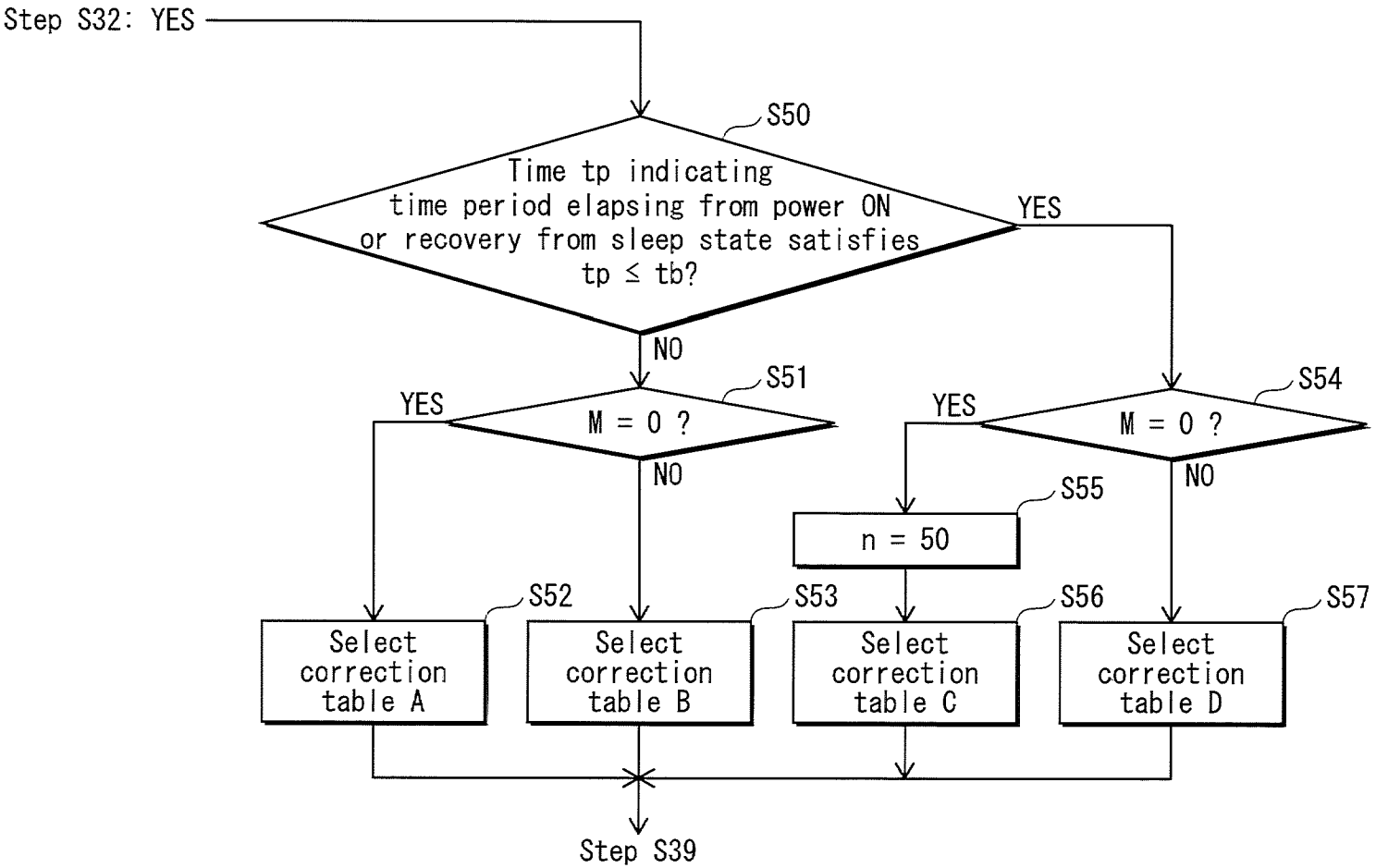
FIG. 11 is a flowchart illustrating a new subroutine executed in place of steps surrounded by chained double-dashed lines in FIG. 9 by the image forming apparatus pertaining to embodiment 2.

FIG. 11 is a flowchart illustrating a new subroutine executed in place of steps surrounded by chained double-dashed lines in FIG. 9 by the control unit 6 in embodiment 2.

When determining that the initial activation period is still continuing in the determination in Step S32 in FIG. 9 (Step S32: YES), the CPU 161 makes a determination of whether a time period tp is equal to or shorter than a predetermined time period tb. Here, the time period tp is a time period from when the printer 1 has been activated or from when the printer 1 has recovered from the long-period sleep state.

When the time period tp is not equal to or shorter than the predetermined time period tb (here, tb is set to five minutes), or that is, when the heater 131*a* has been activated under the same conditions as in embodiment 1, the CPU 161 performs the heater power estimation similar as in embodiment 1.

That is, the CPU 161, when the value of the flag M indicates zero (Step S51: YES), selects the correction table A (Step S52), and executes the processing in Step S39 and on in FIG. 9.

On the other hand, when the value of the flag M does not indicate zero (Step S51: NO), the CPU 161 selects the correction table B (Step S41), and executes the processing in Step S39 and on.

In contrast, when the time period tp is equal to or shorter than the predetermined time period tb (here, tb is set to five minutes), the CPU 161 determines whether the value set to flag M indicates zero. When the value set to flag M indicates zero, or that is, when the flag M indicates the zero-crossing control activation method (Step S54: YES), the CPU 161 sets 50 as the value n indicating the length of the initial activation period, selects the correction table C (Step S56), and executes the processing in Step S39 and on in FIG. 9.

On the other hand, when the value set to flag M does not indicate zero, or that is, when the flag M indicates the phase control activation method (Step S54: NO), the CPU 161 selects the correction table D (Step S57), and executes the processing in Step S39 and on in FIG. 9.

Here, a new value of 50 is set to the value n indicating the length of the initial activation period only in the zero-crossing control activation method. This is since, through the above-described experiments, the present inventors found that the period from the commencement of the activation of the heater 131*a* to when the power consumption of the heater 131*a* becomes stable, or that is, the initial activation period increases only when the zero-crossing control activation method is employed.

The following can be considered as reasons for this.

By the time the printer 1 is activated after being deactivated once or the printer 1 recovers from being in the long-period sleep state, the temperature of the heater 131*a* and the members of the printer 1 located around the heater 1 have dropped to near room temperature.

Here, the members of the printer 1 located around the heater 131*a* refer to the fixing roller 131, the pressurizing roller 132, an undepicted housing that surrounds the fixing unit 30, etc.

Even when the activation of the heater 131*a* is commenced upon the activation of the printer 1 or upon the recovery of the printer 1 from the long-period sleep state and the temperature of the filament of the heater 131*a* rises (to around two thousand and several hundred degrees), a certain amount of time (i.e., the predetermined time period tb) is required for the amount of heat generated by the heater 131*a* and the amount of heat dissipated by the heater 131*a* to balance. This is due to the heat capacity of the above-described members located around the heater 1.

Further, as illustrated in FIG. 6, among the two activation methods of the heater 1, the zero-crossing control activation method, due to its nature, tends to bring about a greater inrush current than the phase control activation method.

As such, when the time period tp is shorter than the predetermined time period tp in the zero-crossing control activation method, a relatively great amount of time is required until the power consumption level of the heater 131*a* stabilizes. This is since, the temperature of the members located around the heater 131*a* is still low when the heater 131*a* is put in activation state, and hence such members conduct heat away from the heater 131*a*, which results in the temperature of the heater 131*a* in activation state being lower than appropriate. Due to this, inrush current of even greater magnitude flows into the heater 131*a*, and a relatively great amount of time is required until the power consumption level of the heater 131*a* stabilizes.

In contrast, when the phase control activation method is employed, the amount of power supplied to the heater 131*a* increases gradually. Therefore, due to the fundamental characteristics of the phase control activation method, the inrush current occurring has a smaller magnitude compared to when the zero-crossing control activation method is employed. As such, the magnitude of the inrush current does not increase by much, and therefore, it can be assumed that the time required for the power consumption level of the heater 131*a* to stabilize is not so long compared to when the zero-crossing control activation method is employed.

As description has been provided up to this point, in embodiment 2, when a power consumption level of a heater is to be estimated, a correction coefficient is determined in accordance with a duration of an immediately preceding non-activation period and a time period elapsing from the recovery of the printer from the long-period sleep state or the activation of the printer, and the power consumption level of the heater is calculated by multiplying a power consumption level of the heater during an initial activation period by the correction coefficient. As such, the power consumption level of the heater can be accurately estimated without the use of a wattmeter or the like, which is expensive and therefore brings about an increase in device cost.

<Modifications>

The present invention is not limited to such embodiments as described above, and modifications as described in the following can be made without departing from the spirit and the scope of the present invention.

(1) In the embodiments, description is provided that the operation panel 7 displays the power consumption level of the entire printer 1, the energy consumption amount of the entire printer 1, and the maximum power consumption level of the entire printer 1 in units of months. However, the present invention is not limited to this, and the operation panel 7 may display any information provided that the information is at least based on the power consumption level of the heater 131*a*.

Further, such information based on the power consumption level of the heater 131*a* may be, for instance, output to an external personal computer, etc,. via the communication I/F unit 166.

In addition, when the printer 1 is provided with a speaker of a like, such information based on the power consumption level of the heater 131*a* may be output in the form of sound. In short, information based on the power consumption level of the heater 131*a* may be output in any form that allows a user to recognize such information.

(2) In the embodiments, the time period tp indicating the time period elapsing from the activation of the printer 1 or the recovery of the printer 1 from the long-period sleep state has been used as a value indicating a surrounding temperature of the heater 131*a*, and the estimation of the power consumption level of the heater 131*a* is performed by selecting one of the correction tables C and D, which are not normally used, according to the time period tp. However, the present invention is not limited to this.

For instance, a temperature sensor for measuring an atmospheric temperature inside the fixing unit 30 may be provided, and the estimation of the power consumption level of the heater 131*a* may be performed by using the correction tables C and D when the temperature inside the fixing unit 30 measured by the temperature sensor is equal to or lower than a predetermined temperature. That is, a determination to use one of the correction tables C and D may be made by acquiring a value indicating a surrounding temperature of the heater 131*a* and when the value is equal to or smaller than a predetermined value.

(3) In the embodiments, the operation panel 7 is described as one example of a component that receives a selection of the activation method of the heater 131*a*. However, the present invention is not limited to this, and the selection of the activation method of the heater 131*a* may be received from an external personal computer via the communication I/F unit 166.

(4) In the embodiments, description is provided based on the presumption that the only component whose power consumption level needs to be estimated while taking into account the influence of the inrush current is the heater 131*a*. However, the present invention is not limited to this, and the estimation of power consumption level may be performed while taking into consideration the influence of the inrush current for components such as one or more motors driving the rollers included in the printer 1 to rotate.

(5) In the embodiments, in the phase control activation method, the triac 154 is controlled to conduct such that the time point at which the duty ratio reaches 100% is set to coincide with the time point at which the value n reaches 70 (i.e., 70 msec). However, the present invention is not limited to this, and the initial activation period need not be set so as to be exactly equal to the time period during which the duty ratio is changed to reach 100% from 0%. The time point required for the duty ratio to reach 100% may be any time point before the time point at which the initial activation period terminates.

This is since, regardless of which of the two activation methods is employed, it is regarded that power corresponding to the rated power level of the heater 131 is consumed during the stable activation period, and therefore, it suffices to stabilize the power consumption level of the heater 131*a* before the initial activation period terminates.

(6) In the embodiments, the fixing roller and the pressurizing roller are pressed against each other so as to form a fixing nip. However, the present invention is not limited to this.

For instance, a pressurizing pad having a surface covered with low friction material may be pressed against the fixing roller instead of the pressurizing roller. In short, any member may be used as the pressurizing member for applying pressure onto the fixing roller provided that the member is capable of applying pressure onto the fixing roller while having an appropriate level of slidability at a surface thereof.

(7) In the embodiments, description is provided on an example where the image forming apparatus pertaining to the present invention is implemented as a tandem-type color digital printer. However, the present invention is not limited to this, and the image forming apparatus pertaining to the present invention may be implemented, for instance, as a monochrome printer. That is, the present invention is applicable to image forming apparatuses including fixing devices in general.

In addition, the present invention may be any combination of the embodiments and the modifications described up to this point.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus having a fixing unit that includes a pressurizing member, a heating rotational body, and a heater, wherein the fixing unit adjusts a temperature of the heating rotational body by switching a state of the heater between a heating state where the heater receives power supply and a non-heating state where the heater does not receive power supply, and the fixing unit, when a recording sheet having an unfixed toner image formed thereon passes through a fixing nip formed between the heating rotational body and the pressurizing member by the pressurizing member pressing against the heating rotational body, heat-fixes the toner image onto the recording sheet, the image forming apparatus comprising:

a storage unit that stores a basic energy consumption rate of the heater determined in advance in a situation where the heater is in the heating state and where inflow of inrush current to the heater is not occurring;

an estimation unit that calculates an estimated energy consumption rate of the heater by (i) estimating, according to a duration of a non-heating state immediately preceding the heating state, an increase in the energy consumption rate of the heater, with respect to the basic energy consumption rate of the heater, brought about by inflow of inrush current to the heater occurring when the heater is switched from the immediately preceding non-heating state to the heating state, and (ii) adding the increase in the energy consumption rate of the heater to the basic energy consumption rate of the heater; and an output unit that outputs the estimated energy consumption rate of the heater.

2. The image forming apparatus of claim 1, wherein the storage unit stores, in addition to the basic energy consumption rate of the heater, a table that associates, in one-to-one correspondence, durations of the non-heating state with values of the increase in the energy consumption rate of the heater, and the estimation unit includes a time measuring subunit that measures the duration of the immediately preceding non-heating state, which commences when the switching is performed while the heater is in a previous heating state and terminates when the heater is switched to the heating state, and estimates the increase in the energy consumption rate of the heater according to the duration of the immediately preceding non-heating state, which is measured by the time measuring subunit, and by referring to the table stored in the storage unit.

3. The image forming apparatus of claim 2 further comprising an acquisition unit that acquires a value indicating a surrounding temperature of the heating rotational body, wherein the table comprises a first sub-table that corresponds to when the value indicating the surrounding temperature is equal to or greater than a predetermined value and a second sub-table that corresponds to when the value indicating the surrounding temperature is smaller than the predetermined value, and the estimation unit estimates the increase in the power consumption rate of the heater by selecting, according to the value indicating the surrounding temperature, a corresponding one of the first sub-table and the second sub-table.

4. The image forming apparatus of claim 2, wherein the image forming apparatus is configured to selectively execute, as a function for controlling the power supplied to the heater during the heating state, one of a first function and a second function differing from the first function, the table comprises two tables each corresponding to a different one of the first function and the second function, and the estimation unit is configured to estimate the increase in the power consumption rate of the heater according to one of the two tables stored in the storage unit corresponding to the selected one of the first function and the second function.

5. The image forming apparatus of claim 3, wherein the values of the increase in the energy consumption rate of the heater, which are associated with the durations of the non-heating state, each indicate a greater value in the second sub-table than in the first sub-table.

6. The image forming apparatus of claim 3, wherein the acquisition unit estimates the value indicating the surrounding temperature of the heating rotational body according to the duration of the immediately preceding non-heating state.

7. The image forming apparatus of claim 1, wherein the estimation unit adds, to the basic energy consumption rate of the heater, the increase in the energy consumption rate of the heater during a period from when the heater is switched from the immediately preceding non-heating state to the heating state to when a duration of the heating state reaches a predetermined duration.

8. The image forming apparatus of claim 1, wherein the estimation unit estimates an amount of energy consumed by the heater according to the estimated energy consumption rate and a duration of a period during which power is supplied to the heater.

9. The image forming apparatus of claim 1, wherein the output unit is a display unit that displays information.

10. An image forming apparatus having a fixing unit that includes a pressurizing member, a heating rotational body, and a heater, wherein the fixing unit adjusts a temperature of the heating rotational body by switching a state of the heater between a heating state where the heater receives power supply and a non-heating state where the heater does not receive power supply, and the fixing unit, when a recording sheet having an unfixed toner image formed thereon passes through a fixing nip formed between the heating rotational body and the pressurizing member by the pressurizing member pressing against the heating rotational body, heat-fixes the toner image onto the recording sheet, the image forming apparatus comprising:

a storage unit that stores a basic energy consumption rate of the heater determined in advance in a situation where the heater is in the heating state and where inflow of inrush current to the heater is not occurring;

an estimation unit that estimates an energy consumption rate of the heater during an initial activation period by multiplying the basic energy consumption rate by a correction coefficient, the correction coefficient calculated in advance by dividing, by the basic energy consumption rate, an energy consumption amount during the initial activation period, the energy consumption amount including an increase brought about by inflow of inrush current to the heater occurring when the heater is switched from the immediately preceding non-heating state to the heating state; and an output unit that outputs the estimated energy consumption rate of the heater.

11. The image forming apparatus of claim 10, wherein the storage unit stores, in addition to the basic energy consumption rate of the heater, a table that associates, in one-to-one correspondence, durations of the non-heating state with the correction coefficient, and the estimation unit includes a time measuring subunit that measures the duration of the immediately preceding non-heating state, which commences when the switching is performed while the heater is in a previous heating state and terminates when the heater is switched to the heating state, and estimates the energy consumption rate of the heater during an initial activation period according to the duration of the immediately preceding non-heating state, which is measured by the time measuring subunit, and by referring to the table stored in the storage unit.

12. The image forming apparatus of claim 11, further comprising an acquisition unit that acquires a value indicating a surrounding temperature of the heating rotational body, wherein the table comprises a first sub-table that corresponds to when the value indicating the surrounding temperature is equal to or greater than a predetermined value and a second subtable that corresponds to when the value indicating the surrounding temperature is smaller than the predetermined value, and the estimation unit estimates the energy consumption rate of the heater during the initial activation period by selecting, according to the value indicating the surrounding temperature, a corresponding one of the first sub-table and the second sub-table.

13. The image forming apparatus of claim 11, wherein the image forming apparatus is configured to selectively execute, as a function for controlling the power supplied to the heater during the heating state, one of a first function and a second function differing from the first function, the table comprises two tables each corresponding to a different one of the first function and the second function, and the estimation unit is configured to estimate the energy consumption rate of the heater during the initial activation period according to one of the two tables stored in the storage unit corresponding to the selected one of the first function and the second function.

14. The image forming apparatus of claim 12, wherein the correction coefficient, which is associated with the durations of the non-heating state, indicates a greater value in the second sub-table than in the first sub-table.

15. The image forming apparatus of claim 12, wherein the acquisition unit estimates the value indicating the surrounding temperature of the heating rotational body according to the duration of the immediately preceding non-heating state.

16. The image forming apparatus of claim 10, wherein the estimation performs the estimation during a period from when the heater is switched from the immediately preceding non-heating state to the heating state to when a duration of the heating state reaches a predetermined duration.

17. The image forming apparatus of claim 10, wherein the estimation unit estimates an amount of energy consumed by the heater according to the energy consumption rate of the heater during the initial activation period and a duration of a period during which power is supplied to the heater.

18. The image forming apparatus of claim 10, wherein the output unit is a display unit that displays information.

* * * * *